US006824367B2

(12) United States Patent
Matsumoto et al.

(10) Patent No.: US 6,824,367 B2
(45) Date of Patent: Nov. 30, 2004

(54) MULTI-STAGE COMPRESSION TYPE ROTARY COMPRESSOR AND A SETTING METHOD OF DISPLACEMENT VOLUME RATIO FOR THE SAME

(75) Inventors: Kenzo Matsumoto, Oizumi-machi (JP); Kazuaki Fujiwara, Ota (JP); Haruhisa Yamasaki, Oizumi-machi (JP); Yoshio Watabe, Ojima-machi (JP); Kentaro Yamaguchi, Oizumi-machi (JP); Noriyuki Tsuda, Oizumi-machi (JP); Masaji Yamanaka, Tatebayashi (JP); Kazuya Sato, Oizumi-machi (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/646,466

(22) Filed: Aug. 22, 2003

(65) Prior Publication Data

US 2004/0071576 A1 Apr. 15, 2004

(30) Foreign Application Priority Data

Aug. 27, 2002 (JP) ..... 2002-247201
Aug. 27, 2002 (JP) ..... 2002-247204
Aug. 29, 2002 (JP) ..... 2002-250927

(51) Int. Cl.[7] ..... F04C 23/00

(52) U.S. Cl. ..... 418/1; 418/11; 418/60; 418/249

(58) Field of Search ..... 418/1, 11, 60, 418/249

(56) References Cited

U.S. PATENT DOCUMENTS 3,130,902 A * 4/1964 Brown ..... 418/249
5,322,424 A * 6/1994 Fujio ..... 418/11

FOREIGN PATENT DOCUMENTS

| | | | | |
|---|---|---|---|---|
| EP | 0 935 106 A2 | | 8/1999 | |
| JP | 60-128990 | * | 7/1985 | 418/11 |
| JP | 62-29788 | * | 2/1987 | 418/11 |
| JP | 1-247785 | * | 10/1989 | 418/11 |
| JP | 2-294586 | | 12/1990 | |
| JP | 2-294587 | * | 12/1990 | 418/11 |
| JP | 2-294588 | * | 12/1990 | 418/11 |
| JP | 11-294877 | * | 10/1999 | |
| JP | 2001-132675 | | 5/2001 | |
| JP | 2002-107027 | * | 4/2002 | |

* cited by examiner

*Primary Examiner*—John J. Vrablik
(74) *Attorney, Agent, or Firm*—J. C. Patents

(57) ABSTRACT

A multi-stage compression type rotary compressor 10 is provided with an electrical-power element 14, the first and second rotary compression elements 32, 34 driven by a rotary shaft 16 of the electrical-power element 14 in a sealed vessel 12. The refrigerant compressed by the first rotary compression element 32 is compressed by the second rotary compression element 34. The refrigerant is combustible. The refrigerant compressed by the first rotary compression element 32 is discharged to the sealed vessel 12. The discharged medium pressure refrigerant is compressed by the second rotary compression element 34. Additionally, the displacement volume ratio of the second rotary compression element 34 to the first rotary compression element 32 is set not less than 60% and not more than 90%. By using the multi-stage compression type rotary compressor, a rotary compressor using a combustible refrigerant can be carried out.

13 Claims, 11 Drawing Sheets

MULTI-STAGE COMPRESSION TYPE ROTARY COMPRESSOR AND A SETTING METHOD OF DISPLACEMENT VOLUME RATIO FOR THE SAME

CROSS-REFERENCE TO RELATED APPLICATION

This application claims the priority benefit of Japanese applications serial no. 2002-247201, filed on Aug. 27, 2002; serial no. 2002-247204, filed on Aug. 27, 2002; serial no. 2002-250927, filed on Aug. 29, 2002.

BACKGROUND OF THE INVENTION

1. Field of the Invention

The present invention relates to a multi-stage compression type rotary compressor comprising an electrical-power element arranged within a sealed vessel, a first and a second rotary compression element that is driven by the rotary shaft of the electrical-power element, wherein the refrigerant compressed by the first rotary compression element is compressed by the second rotary compression element, and the refrigerant gas compressed and discharged by the first rotary compression element is sucked to the second rotary compression element and is compressed and discharged thereby. The present invention also relates to a setting method of displacement volume ratio for the multi-stage compression type rotary compressor.

2. Description of the Related Art

A conventional rotary compressor sucks the refrigerant gas to the low-pressure chamber side of a cylinder through a suction port of the rotary compression element. The refrigerant gas compressed by the operations of a roller and a vane is temporarily discharged into the sealed vessel through the discharge port at the high-pressure chamber side of the cylinder and then is discharged to outside through the sealed vessel. The vane is installed movably in a groove formed in a radial direction of the cylinder. The vane is pressed against the roller to divide an inside of the cylinder into a low-pressure chamber side and a high-pressure chamber side. A spring is provided on a rear side of the vane to urge this vane on a roller side. A back pressure chamber that communicates with the sealed vessel is set within the groove for urging the vane on the roller side. Therefore, the high-pressure inside the sealed vessel is charged to the back pressure chamber and urges the vane on the roller side.

In this rotary compressor, the application of refrigerant with combustibility, such as propane (R290), HC refrigerant excluding Freon has been considered due to the damage of the ozone layer resulting from Freon refrigerant.

It is necessary to make the sealing amount of the combustible refrigerant such as, a propane in low amount, due to the security consideration. The security limitation for propane serving as refrigerant is 150 g. However, it is necessary to limit the sealing amount to be 100 g for sufficient security in practice (50 g for refrigerator using).

Because the refrigerant is discharged after being compressed in the sealed vessel in the rotary compressor, the sealed volume of the refrigerant must be in excess of 30 g ~50 g compared to the refrigerant in a reciprocating compressor with the same volume as the rotary compressor. Therefore, the regulatory stringent regarding to the use of the rotary compressor with combustible refrigerant.

The conventional multi-stage compression type rotary compressor, as shown in FIG. 13, sucks the refrigerant gas to the low-pressure chamber side of the cylinder 240 through the suction port 262 of the first rotary compression element 232. The refrigerant gas is compressed to a medium pressure by operations of the roller 248 and the vane 252 and is discharged through the discharge port 272 at the high-pressure chamber side of the cylinder 240. Therefore, the medium pressure refrigerant gas is sucked to the low-pressure chamber side of the cylinder 238 through the suction port 261 of the second rotary compression element 234. The second compression of the refrigerant gas is done by the operations of the roller 246 and the vane 250 to make the refrigerant have high temperature and high pressure, and the refrigerant is then discharged through the discharge port 270 at the high-pressure chamber side. The refrigerant discharged by the compressor flows into a radiator. After the refrigerant has been radiated, it is closed in the expansion valve and then is heat-absorbed by the evaporator and sucked to the first rotary compression element 232. This cycle is repeated. Furthermore, in FIG. 13, the reference numeral 216 indicates a rotary shaft of the electrical-power element. The reference numerals 227, 228 indicate discharge valves set inside the discharge-muffler chamber 262, 264 to open or close the discharge ports 270, 272.

The displacement volume of the second rotary compression element 234 is set smaller than that of the first rotary compression element 232. Under this condition, in the conventional rotary compressor, the thickness (height) of the cylinder 240 of the first rotary compression element 232 is made smaller than that of the cylinder 238 of the second rotary compression element 234; the internal diameter of the cylinder 238 of the second rotary compression element 234 is made smaller than that of the cylinder 240 of the first rotary compression element 232; the eccentric amount of the roller 246 of the second rotary compression element 234 is made small (the external diameter of the roller 246 is made large). By doing so, the displacement volume of the second rotary compression element 234 is set to be smaller that of the first rotary compression element 232.

SUMMARY OF THE INVENTION

It is to be discussed that the use of the combustible refrigerant that exerts medium pressure in the sealed vessel in the multi-stage compression type rotary compressor. The pressure inside the sealed vessel is relatively low compared to the high pressure refrigerant gas discharged into the sealed vessel. In other words, because the low pressure refrigerant has low density, the amount of the refrigerant existing in the sealed vessel can be reduced. Especially, in the case when the ratio of displacement volume of the second rotary compression element to the first rotary compression element is large, the medium pressure is difficult to rise. Therefore, the amount of the refrigerant that is sealed within the sealed vessel can be further reduced.

However, in a case when the medium pressure is lowered in the sealed vessel in the rotary compressor, during the start-up of the compressor, the pressure inside the sealed vessel that serves as a back pressure and is charged to the vane of the first rotary compression element is difficult to rise, this may break away the vanes.

Moreover, because it takes time in the internal medium-pressure compressor to reach a balanced pressure after the rotary compressor stops, the startability of re-start-up is poor.

The displacement volume ratio of the multi-stage compression type rotary compressor has suitable values according to the various usages. For each suitable value, parts must be replaced (including the changing of the material type, working equipment and measuring instrument, etc.) in the eccentric amount of the rotary shaft, the external diameter of the roller or the internal diameter·height of the cylinder. Moreover, due to the difference of the eccentric amount of the rotary shaft between the first rotary compression element and the second rotary compression element, the working of the rotary shaft is divided into more steps.

Thus, the manufacturing time that is spent on replacing parts becomes longer, and the cost (including the cost on change of the material type, working equipment and measuring instrument, etc.) due to the changing or replacements of parts becomes high.

The present invention resolves the problems caused by the conventional rotary compressor. An object of the present invention is to prevent unstable movements such as breakaway of the vane in the internal medium-pressure, multi-stage compression type rotary compressor using combustible refrigerant. It is another object of the present invention to improve the startability of the compressor.

Moreover, still another object of the present invention is to provide a multi-stage compression type rotary compressor and a setting method of displacement volume ratio thereof. In the compressor, the cost can be lowered, the workability can be improved and the optimum displacement volume ratio can be easily set.

Another object of the present invention is to provide a multi-stage compression type rotary compressor that uses combustible refrigerant as refrigerant. The refrigerant that has been compressed by the first rotary compression element is discharged to the sealed vessel. The discharged medium pressure refrigerant is compressed by the second rotary compression element. Therefore, the pressure inside the sealed vessel becomes medium pressure. The gas density of the refrigerant that is discharged to the sealed vessel becomes low.

Another object of the present is to provide a multi-stage compression type rotary compressor, wherein the displacement volume ratio of the second rotary compression element to the first rotary compression element is set large.

Yet another object of the present invention is to provide a multi-stage compression type rotary compressor, wherein the displacement volume ratio of the second rotary compression element to the first rotary compression element is not less than 60%. The medium pressure that is compressed by the first rotary compression element is limited. Therefore, the gas density of the refrigerant inside the sealed vessel can be lowered. The pressure is relative low compared to an internal high-pressure, single-stage compression type compressor. Therefore, the amount of refrigerant melted into oil can also be lowered.

Still another object of the present invention is to provide a multi-stage compression type rotary compressor, wherein the displacement volume ratio of the second rotary compression element to the first rotary compression element is not less than 60% and not more than 90%. Therefore, the unstable operation of the first rotary compression element can be prevented, and the gas density of the refrigerant that is discharged to the sealed vessel can be lowered.

Still another object of the present invention is to provide a multi-stage compression type rotary compressor, wherein the volume ratio of the space where the refrigerant exists to the volume of the sealed vessel is not less than 60%. Therefore, the existing space of the refrigerant gas inside the sealed vessel becomes small, and the amount of sealed refrigerant can be lowered.

Still another object of the present invention is to provide a multi-stage compression type rotary compressor, wherein the first and second cylinders constructing the first and second rotary compression elements, the first and second support members that block each opening face of the cylinders and serves also as a bearing for the rotary shaft, and intermediate partition plates that are arranged between cylinders are shaped close to the inner surface of the sealed vessel. Therefore, the existing space of the refrigerant gas in the sealed vessel can be efficiently lessened, and the amount of sealed refrigerant and oil can be remarkably lowered.

Still another object of the present invention is to provide a multi-stage compression type rotary compressor comprising: the first and second cylinders constructing the first and second rotary compression elements, the first and second rollers that rotates eccentrically with eccentric portions formed on the rotary shaft of the electrical-power element, the first and the second vanes that are in contact with rollers to divide each cylinder into a low-pressure chamber side and a high-pressure chamber side, and the first and second back pressure chambers for constantly urging each vane towards the roller side. A combustible refrigerant is applied as a refrigerant. The refrigerant that has been compressed by the first rotary compression element is discharged to the sealed vessel. The discharged medium pressure refrigerant gas is compressed by the second rotary compression element. At the same time, the discharging side of the refrigerant in the second rotary compression element is connected to the first and second back pressure chambers. Therefore, the high pressure refrigerant gas that has been compressed by the second rotary compression element is charged into the first and second back pressure chambers.

Still another object of the present invention is to provide a multi-stage compression type rotary compressor comprising: a support member that blocks the opening face of the second cylinder, a discharge-muffler chamber formed in the support member for discharging the refrigerant that has been compressed in the second cylinder, a communication path formed in the support member and communicating with the discharge-muffler chamber and the second back pressure chamber, an intermediate partition plate arranged between the first and second cylinders, and a communication hole formed in the intermediate partition plate for communicating with the second and first back pressure chambers. Therefore, the high-pressure at the discharging side of the refrigerant in the second rotary compression element can be charged into the first and second back pressure chambers with a relatively simple structure.

Still another object of the present invention is to provide a multi-stage compression type rotary compressor comprising: a pressure equalizing passage that communicates with the discharge-muffler chamber and the sealed vessel, and a pressure equalizing valve that opens or closes the pressure equalizing passage. The pressure equalizing valve opens the pressure equalizing passage when the pressure inside the discharge-muffler chamber is lower than that inside the sealed vessel. Therefore, the pressure within the first and second rotary compression elements and the sealed vessel can be rapidly equalized.

Still another object of the present invention is to provide a multi-stage compression type rotary compressor using a combustible refrigerant, wherein the refrigerant that has been compressed by the first rotary compression element is discharged to the sealed vessel. The medium pressure refrigerant that has been discharged is compressed by the second rotary compression element. The compressor comprises a pressure equalizing valve that communicates with the discharging side of the refrigerant in the second rotary compression element and the sealed vessel in the case when the pressure at the discharging side of the refrigerant in the second rotary compression element is lower than the pressure inside the sealed vessel. Thus, after the compressor stops, the pressure within the sealed vessel can be rapidly equalized.

Still another object of the present invention is to provide a multi-stage compression type rotary compressor comprising: a cylinder that constructs the second rotary compression element, a support member that blocks the opening face of the cylinder, a discharge-muffler chamber formed in the support member and discharging the refrigerant that has been compressed in the cylinder, a cover that divides the discharge-muffler chamber and the sealed vessel, and a pressure equalizing passage formed in the cover. The pressure equalizing valve is arranged inside the discharge-muffler chamber to open or close the pressure equalizing passage. Therefore, the structure of the compressor is simplified and the efficiency of space-usage can be improved.

Still another object of the present invention is to provide a multi-stage compression type rotary compressor, wherein the dimensions of the first and second eccentric portions are same, and the dimensions of the first and second rollers are same, and the dimensions of the first and second cylinders are same. The second cylinder extends outwardly with a predetermined angle range in the rotation direction of the second roller from the suction port. Therefore, the starting of the compression of the refrigerant in the cylinder of the second rotary compression element becomes delayed.

Still another object of the present invention is to provide a setting method of displacement volume ratio for the multi-stage compression type rotary compressor. The method comprises: extending the second cylinder outwardly with a predetermined angle range in the rotation direction of the second roller from the suction port; setting the displacement volume ratio of the first and second rotary compression elements by adjusting the compression-starting-angle. Therefore, the starting of the compression of the refrigerant in the cylinder in the second rotary compression element can be delayed. The displacement volume of the second rotary compression element can be lowered.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the following accompanying drawings.

DESCRIPTION OF THE PREFERRED EMBODIMENT

Figure 1:
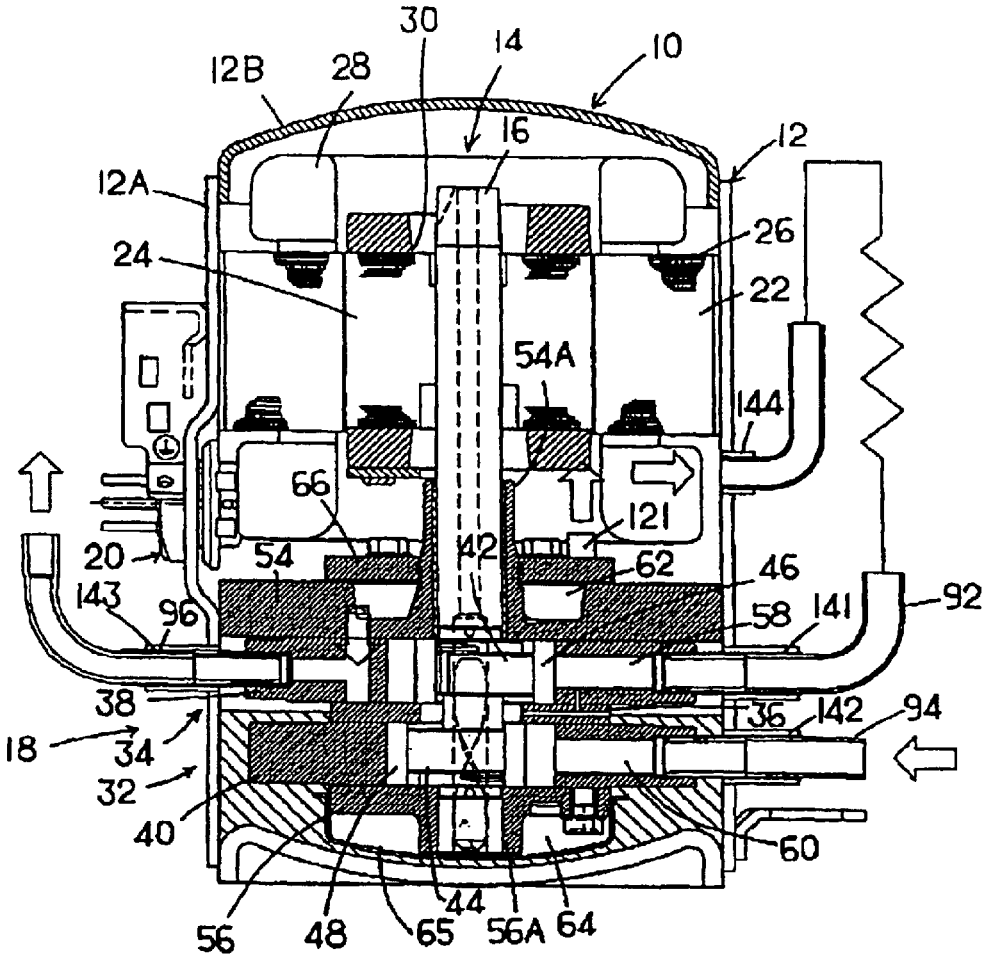
FIG. 1 is a vertical cross-sectional view showing a multi-stage compression type rotary compressor of medium pressure type according to an embodiment of the present invention.

Preferred embodiments of the present invention will be hereinafter described with reference to the accompanying drawings. FIG. 1 shows a cross-sectional view of a multi-stage compression type rotary compressor according to one embodiment of the invention. The internal medium-pressure, multi-stage (two-stage) compression type rotary compressor 10 comprises the first and second rotary compression elements 32, 34.

In FIG. 1, the rotary compressor 10 is an internal medium-pressure, multi-stage compression type rotary compressor using propane (R290) as a refrigerant. The multi-stage compression type rotary compressor 10 comprises a sealed vessel 12, an electrical-power element 14 and a rotary compression mechanism portion 18. The sealed vessel 12 serving as a case is formed with a cylindrical vessel body 12A made of a steel plate and a end cap (lid) 12B with a substantial bowl shape that closes the upper opening of the vessel body 12A. The electrical-power element 14 is arranged in the upper side of the inner space of the vessel body 12A of the sealed vessel 12. The rotary compression mechanism portion 18 is constructed with the first and second rotary compression elements 32, 34 that are arranged under the electrical-power element 14 and are driven by the rotary shaft 16 of the electrical-power element 14.

Additionally, the bottom of the sealed vessel 12 is used as an oil reservoir (see the hatched part in FIG. 1). A terminal 20 whose wires are omitted is installed on the side surface of the vessel body 12A for supplying electrical-power to the electrical-power element 14.

The electrical-power element 14 comprises a stator 22 that is annularly installed along the upper inner surface of the sealed vessel 12 and a rotor 24 inserted in a gap enclosed by the stator 22. Thus, the rotary shaft 16 is fixed on the rotor 24 along a vertical direction.

The stator 22 has a stack 26 that is laminated with a donut-shaped electromagnetic steel plate and a stator coil 28 that is distributed-wired. Moreover, the rotor 24 comprises a stack 30 made of an electromagnetic steel plate.

The intermediate partition plate 36 is sandwiched between the first rotary compression element 32 and the second rotary compression element 34. That is, a combination of the first rotary compression element 32 and the second rotary compression element 34 is composed of the intermediate partition plate 36, an upper cylinder (the second cylinder) 38 and a lower cylinder (the first cylinder) 40 arranged above and below the intermediate partition plate 36 respectively, an upper roller 46 (the second roller) and a lower roller 48 (the first roller) which eccentrically revolve within the upper and lower cylinders 38 and 40 respectively at upper and lower eccentric portions 42 and 44 provided on the rotary shaft 16 with a phase difference of 180 degrees therebetween, vanes 50 (the second vane) and 52 (the first vane) which butts against the upper and lower rollers 46, 48 to divide an inside of the respective upper and lower cylinders 38 and 40 into a low-pressure chamber side and a high-pressure chamber side, and an upper-part support member 54 and a lower-part support member 56 given as a support member for blocking an upper-side opening face of the upper cylinder 38 and a lower-side opening face of the lower cylinder 40 respectively to serve also as a bearing for the rotary shaft 16.

Figure 5:
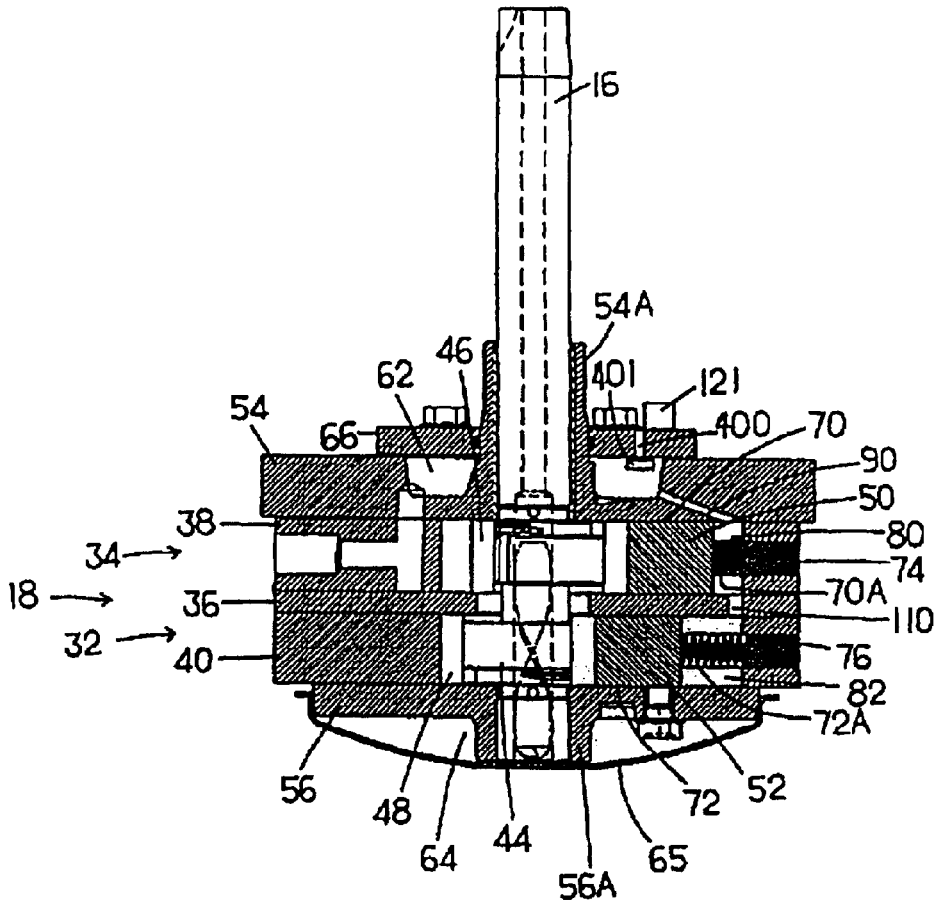
FIG. 5 is an expanded vertical cross-sectional view showing a first and second rotary compression mechanism portions of the multi-stage compression type rotary compressor of medium pressure type of the present invention.

Guide grooves 70, 72 for receiving vanes 50, 52 are formed in the upper and lower cylinders 38, 40 that construct the first and second rotary compression elements 32, 34, as shown in FIG. 5. Receiving portions 70A, 72A for receiving springs 74, 76 serving as resilient members are formed on the external side of the guide grooves 70, 72, i.e. the backside of the vanes 50, 52. The springs 74, 76 butt against the end of the backside of the vanes 50, 52 and constantly urge the vanes 50, 52 on sides of rollers 46, 48. Therefore, the receiving portions 70A, 72A are opened towards the side of the guide grooves 70, 72 and the side of the sealed vessel 12 (vessel body 12A). Plugs (not shown) are provided on a side of the sealed vessel 12 with respect to the springs 74, 76 received in the receiving portions 70, 72 respectively, for preventing fall-out of the springs 74,76. Furthermore, O-rings (not shown) are positioned on a peripheral face of plugs for sealing each plug and an inner face of the receiving portions 70A, 72A.

In order to constantly urge the spring 74 and the vane 50 on the side of the roller 46, a second back pressure chamber 80 for exerting a discharging pressure of the refrigerant in the second rotary compression element 34 is set between the guide groove 70 and the receiving portion 70A. The upper surface of the second back pressure chamber 80 is connected to a communication path 90. The lower surface of the second back pressure chamber 80 is connected to a first back pressure chamber 82 through a communication hole 110 formed on the intermediate partition plate 36.

With the above structure, by connecting the discharge-muffler chamber 62 and the second back pressure chamber 80 to the communication path 90, the high pressure refrigerant compressed by the second rotary compression element 34 and been discharged to the discharge-muffler chamber 62 can be charged into the second back pressure chamber 80 through the communication path 90. With this structure, the vane 50 is sufficiently urged on the side of the roller 46. Therefore, the unstable movement of the second rotary compression element 34 such as breakaway of the vane can be prevented.

The first back pressure chamber 82, for constantly urging the spring 76 and vane 52 on the side of the roller 48, is set between the receiving portion 72A and the guide groove 72 for receiving the vane 52 of the lower cylinder 40. The upper surface of the first back pressure chamber 82 is connected to the second back pressure chamber 80 through the communication hole 110.

With the above structure, by using the communication hole 110 to connect the second back pressure chamber 80 with the first back pressure chamber 82, the high pressure refrigerant gas in the discharge-muffler chamber 62 that is charged into the second back pressure chamber 80 through the communication path 90 can be led into the first back pressure chamber 82. With this structure, the vane 52 is sufficiently urged on the side of the roller 48. Therefore, the unstable movement of the first rotary compression element 32 such as breakaway of the vane can be prevented.

Especially, in the present invention, the sealed vessel 12 is under a medium pressure condition, and by setting the displacement volume ratio of the second rotary compression element 34 to the first rotary compression element 32 at a larger value, the medium pressure of the sealed vessel 12 can be further depressed. The problem of applying insufficient back pressure resulting from limitation to further raise the pressure within the sealed vessel 12 at the starting stage of the rotary compressor 10 can be prevented. With this structure, the reliability of the rotary compressor 10 can be improved.

Additionally, by only forming the communication path 90 on the upper-part support member 54 and forming the communication hole 110 on the intermediate partition plate 36, a sufficient back pressure can exerted on the vanes 50, 52 without requiring any other special mechanism. Therefore, the working cost can be lowered and a rotary compressor 10 with high-reliability can be manufactured.

Suction paths 58, 60 for connecting the upper and lower cylinders 38, 40 with each other through a suction port (not shown) are set in the upper and lower cylinders 38, 40. The discharge-muffler chamber 62 is set in the upper-part support member 54. The discharge-muffler chamber 62 blocks the refrigerant gas compressed in the upper cylinder 38 through the discharge port 39 by blocking concavities in the upper-part support member 54 by a cover serving as a wall. In other words, the discharge-muffler chamber 62 is blocked by the upper cover 66 that also serves as a wall the discharge-muffler chamber 62.

The communication path 90 is formed in the upper-part support member 54. The communication path 90 connects the second back pressure chamber 80 and the discharge-muffler chamber 62 that is connected to the discharge port 39 of the upper cylinder 38 of the second rotary compression element 34.

Figure 6:
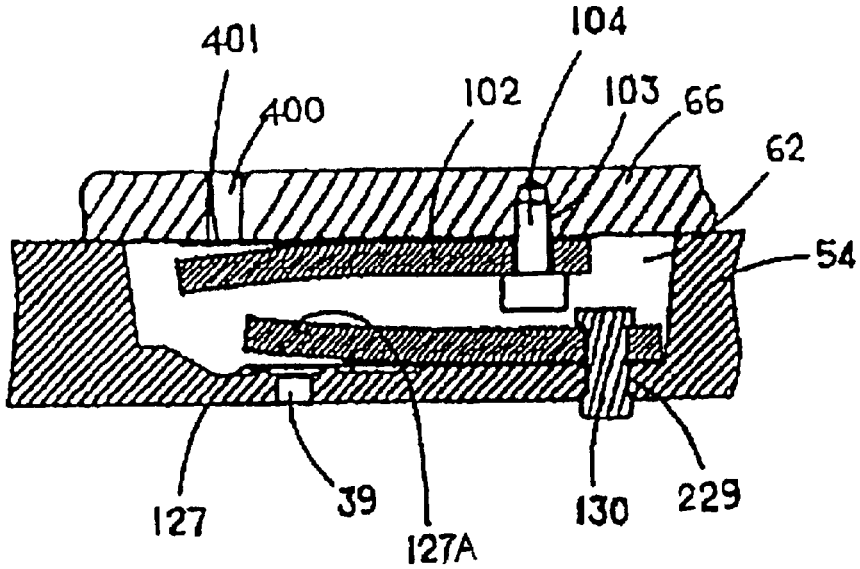
FIG. 6 is an expanded vertical cross-sectional view showing a discharge-muffler chamber of the second rotary compression element of the present invention.

A pressure equalizing passage 400 for connecting the sealed vessel 12 and the discharge-muffler chamber 62 is formed in the upper cover 66, as shown in FIG. 6. The pressure equalizing passage 400 is a through hole that penetrates the cover 66. A pressure equalizing valve 401 installed in the discharge-muffler chamber 62 opens or closes the lower surface of the pressure equalizing passage 400.

The pressure equalizing valve 401 is constituted of a resilient member made of a vertically long rectangle metal plate. A backer valve 102 serving as a plate for limiting the pressure equalizing valve 401 is arranged at lower side of the pressure equalizing valve 401 and is installed under the upper cover 66. Thus, one side of the pressure equalizing valve 401 butts against the pressure equalizing passage 400, such that the pressure equalizing valve 401 is sealed. The other side of the pressure equalizing valve 401 is fixed in an attachment hole 103 of the upper cover 66 that is separated from the pressure equalizing passage 400 by a rivet 104.

After the rotary compressor 10 stops, once the pressure of the discharge-muffler chamber 62 is smaller than that of the sealed vessel 12, the pressure inside the sealed vessel 12 will press against the pressure valve 401 that closes the pressure equalizing passage 400 from the upper side of FIG. 6, to open the pressure equalizing passage 400. The pressure inside the sealed vessel 12 is then discharged towards the discharge-muffler chamber 62. At this time, because the other side of the pressure equalizing valve 401 is fixed on the upper cover 66, the side that in contact with the pressure equalizing passage 400 bends downwardly and is in contact with a backer valve 102 that limits the extent or degree of opening of the pressure equalizing valve. Therefore, the pressure inside the discharge-muffler chamber 62 is the same as that inside the sealed vessel 12. Otherwise once the pressure inside the discharge-muffler chamber 62 is larger than that inside the sealed vessel 12, the pressure equalizing valve 401 separates from the backer valve 102 and closes the pressure equalizing passage 400.

According to one aspect of the present invention, once the pressure of the discharge-muffler chamber 62 is smaller than that of the sealed vessel 12, the pressure equalizing passage 400 is opened and the pressure is discharged towards the discharge-muffler chamber 62. After, the rotary compressor 10 stops, the medium pressure within the sealed vessel 12 falls easily and thus the phenomenon of difficult falling of the pressure within the sealed vessel after the compressor stops as in the case of the prior art can be effectively prevented. With this structure, the pressure-equalization of the discharge-muffler chamber 62 and the sealed vessel 12 can be hastened.

Moreover, the pressure equalizing valve 401 is set within the discharge-muffler chamber 62. Even if the upper electrical-power element 14 approaches the upper cover 66, the upper electrical-power element 14 will not interfere with the pressure equalizing valve 401. Therefore, the efficiency of space-usage is improved. Further miniaturization of the rotary compressor 10 can be realized. Additionally, the pressure equalizing valve 401 is installed under the upper cover 66. The installation operation is easy.

A discharge valve 127 (not shown in FIGS. 1 and 5) for opening or closing the discharge port 39 is set under the discharge-muffler chamber 62. The discharge valve 127 is constituted of a resilient member made of a vertically long rectangle metal plate. A backer valve 127A serving as a plate for limiting the discharge valve 127 is arranged at upper side of the discharge valve 127 and is installed in the upper-part support member 54. Thus, one side of the discharge valve 127 butts against the discharge port 39, such that the discharge valve 127 is sealed. The other side of the discharge valve 127 is fixed on the support member 54 by securing a rivet 130 into an attachment hole 229 of the support member 54 that is positioned laterally adjacent to the discharge port 39.

Referring to FIG. 6, the compressed refrigerant gas in the upper cylinder 38 upon reaching a predetermined pressure presses the discharge valve 127 that closes the discharge port 39 upwardly from the lower side in order to open the discharge port 39. The refrigerant gas is then discharged towards the discharge-muffler chamber 62. At this time, the other side of the discharge valve 127 remains fixed in the upper-part support member 54. Therefore, the side of the discharge valve 127 that butts against the discharge port 39 bends upwardly to butt against the backer valve (not shown) that limits the extent or degree of opening of the discharge valve 127. When the discharge of the refrigerant gas is completed, the discharge valve 127 separates from the backer valve and blocks the discharge port 39.

On the other hand, the refrigerant gas that has been compressed in the lower cylinder 40 is discharged into the discharge-muffler chamber 64 through the discharge port (not shown). The discharge-muffler chamber 64 is formed at a side (the bottom side of the sealed vessel 12) opposite to the electrical-power element 14 of the lower-part support member 56. The discharge-muffler chamber 64 has a hole located at its center allowing the rotary shaft 16 and the lower-part support member 56 serving as the bearing of the rotary shaft 16 to pass through. The discharge-muffler chamber 64 also comprises a cup 65 for covering the side opposite to the electrical-power element 14 of the lower-part support member 56.

In this case, a bearing 54A is protrusively formed at the center of the upper-part support member 54. A bearing 56A is formed by penetrating the center of the lower-part support member 56. The rotary shaft 16 is held by the bearing 54A of the upper-part support member 54 and the bearing 56A of the lower-part support member 56.

The discharge-muffler chamber 64 of the first rotary compression element 32 and the sealed vessel 12 are connected by a communication path. This communication path is comprised of a through hole (not shown) passing the lower and upper-part support members 56, 54, the upper cover 66, the upper and lower cylinders 38, 40, and the intermediate partition plate 36. In this case, an intermediate discharge pipe 121 is set vertically on the upper end of the communication path. A medium pressure refrigerant gas 12 is discharged into the sealed vessel through the intermediate discharge pipe 121.

According to one aspect of the present invention, the medium pressure refrigerant gas that has been compressed by the first rotary compression element 32 is discharged to the sealed vessel 12. Comparing with the condition of discharging the high pressure refrigerant gas into the sealed vessel 12, the amount of the refrigerant to be discharged to the sealed vessel 12 is lowered. In other words, because the refrigerant with lower pressure has lower density, the condition that discharging the medium pressure refrigerant gas into the sealed vessel 12 has a lower density of refrigerant gas compared to that of discharging the high pressure refrigerant gas into the sealed vessel 12. The amount of the refrigerant existing in the sealed vessel 12 becomes lessened.

Figure 7:
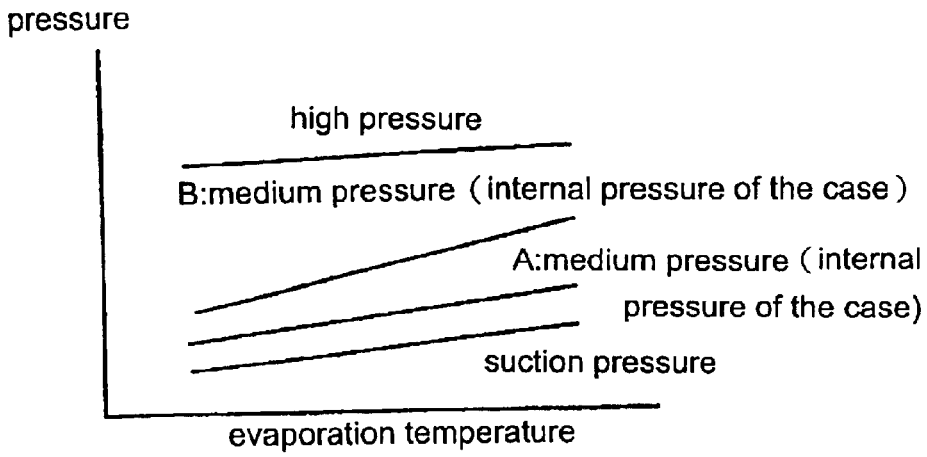
FIG. 7 is a graph showing a relationship of the pressure (suction pressure and high pressure) versus evaporation temperature in the multi-stage compression type rotary compressor of medium pressure type.
Figure 8:
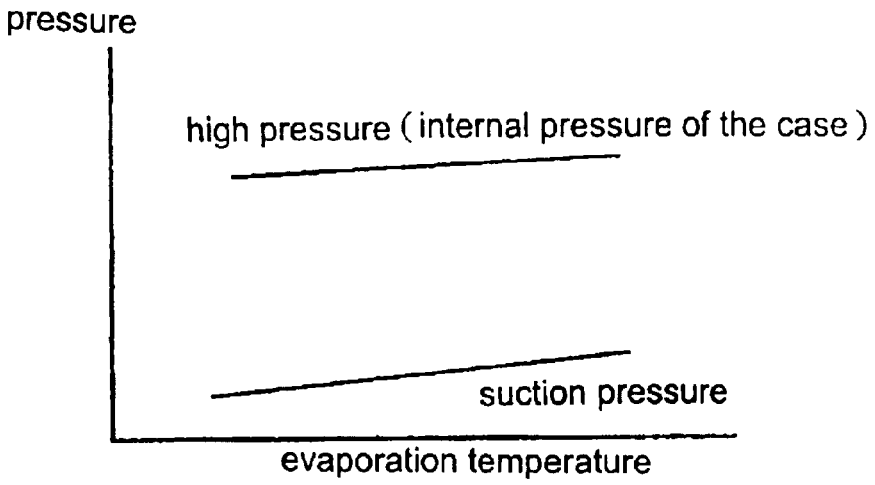
FIG. 8 is a graph showing a relationship of the pressure (suction pressure and high pressure) versus evaporation temperature in the single-stage compression type rotary compressor.

Referring to FIGS. 7 and 8, FIG. 7 shows a graph illustrating the relationship of the evaporation temperature of the refrigerant versus the pressure of the internal medium-pressure multi-stage compression type rotary compressor 10 of the present invention, wherein the low pressure is the suction pressure of the first rotary compression element 32; the medium pressure is the internal pressure of the case in the sealed vessel 12; and the high pressure is the discharging pressure of the second rotary compression element 34. FIG. 8 shows a graph illustrating the relationship of the evaporation temperature versus the pressure (the suction pressure; the high pressure, i.e. the internal pressure of the case) of the single-stage compression type rotary compressor under the condition that the same high-pressure is discharged to the sealed vessel. Thus it is evident from these two Figs., the internal medium-pressure, multi-stage compression type rotary compressor 10 of the present invention has a much lower pressure in the sealed vessel compared to the single-stage compression type rotary compressor. Therefore, the sealed amount of the refrigerant in the sealed vessel 12 can be lowered.

Moreover, in the preferred embodiment, the displacement volume ratio of the second rotary compression element 34 to the first rotary compression element 32 is set large. For example, the displacement volume ratio of the second rotary compression element 34 to the first rotary compression element 32 is set not less than 60% and not more than 90%. The example in FIG. 7 shows the condition of the medium pressure with the ratio to be 60%; the example A shows the condition of the medium pressure with the ratio to be 90%.

In the conventional multi-stage compression type rotary compressor, the displacement volume ratio of the second rotary compression element 34 to the first rotary compression element 32 is about 57%. However, at this high displacement volume ratio, the medium pressure is still high. With this conventional structure, the density of the refrigerant gas discharged into the sealed vessel 12 becomes high. The amount of the refrigerant to be sealed in the rotary compressor 10 must be large. If the displacement volume ratio of the second rotary compression element 34 to the first rotary compression element 32 is set not less than 60% as in the case of the preferred embodiment of the present invention, the amount of the refrigerant in the sealed vessel 12 becomes lowered. The amount of the refrigerant melted into oil can be substantially lowered, because the vessel is within a medium pressure and not under the high pressure.

It can be understood from FIG. 7 that in the case when the displacement volume ratio of the second rotary compression element 34 to the first rotary compression element 32 is set at larger than 90%, the suction pressure of the first rotary compression element 32 for sucking the refrigerant is almost the same as the medium pressure within the sealed vessel 12. The refrigerant cannot be sufficiently compressed by the first rotary compression element 32. Besides, the urging force due to the vane of the first rotary compression element 32 is not enough, such that the vane breaks away. Pressure-oil-feeding from the accumulator arranged at the internal bottom of the sealed vessel 12 is not sufficient. The unstable movement of the rotary compressor 10 occurs.

By setting the displacement volume ratio of the second rotary compression element 34 to the first rotary compression element 32 at not less than 60% and not more than 90% as required in the preferred embodiment of the present invention, the phenomena of unstable movement such as breakaway of the vane can be prevented. The pressure-difference of the first stage (the pressure difference between the suction pressure of the first rotary compression element 32 and the discharging pressure (medium pressure) of the first rotary compression element 32) can be set small, the density of the refrigerant gas discharged into the sealed vessel 12 and the amount of the refrigerant melted into oil can be lowered.

In other words, by lowering the density of the gas, the amount of the refrigerant gas discharged into the vessel 12 and the amount of the refrigerant gas melted into oil in the sealed vessel 12 can be further decreased. Therefore, the amount of the refrigerant gas sealed in the sealed vessel 12 can be lowered.

The upper cover 66 forms a discharge-muffler chamber 62 that communicates with the upper cylinder 38 of the second rotary compression element 34 and the discharge port 39. The electrical-power element 14 is separately arranged above the upper cover 66 with a predetermined gap. The upper cover 66 is made of a substantially donut-shaped steel plate with a through hole allowing the bearing 54A of the upper-part support member 54 to pass through.

In this case, the preferred embodiment uses a combustible refrigerant, such as propane (R290). Moreover, other combustible refrigerant, such as an isobutane (R600a), can also used to practice the present invention, or the material with high-combustibility that is stipulated by the ASHRAE Std 34 Safety group, such as methane (R50), ethane (R170), propane (R290), butane (R600), and propylene (R1270) may also used to practice the present invention.

On a side face of the vessel body 12A of the sealed vessel 12, sleeves 141, 142, 143 and 144 are fixed by welding at positions corresponding to the suction paths 58 and 60, the side opposite to the suction path 58 of the cylinder 38, and the lower side of the rotor 24 (right under the electrical-power element 14) respectively. The sleeves 141, 142 are adjacent to each other vertically. The sleeve 143 is positioned roughly diagonal to the sleeve 141. Furthermore, the sleeve 144 is positioned above the sleeve 141.

One end of a refrigerant inlet pipe 92 is inserted and connected to the sleeve 141 for introducing a refrigerant gas into the upper cylinder 38, whose one end communicates with the suction path 58 of the upper cylinder 38. This refrigerant inlet pipe 92 passes through the outside of the sealed vessel 12 up to the sleeve 144, while the other end is inserted and connected to the sleeve 144 to communicate with the inside of the sealed vessel 12.

One end of a refrigerant inlet pipe 94 is inserted and connected to the sleeve 142 for introducing a refrigerant gas into the lower cylinder 40, whose one end communicates with the suction path 60 of the lower cylinder 40. Furthermore, a refrigerant discharge pipe 96 is inserted and connected to the sleeve 143 one end of which communicates with the discharge-muffler chamber 62.

The following will describe operations of the above structure. When the stator coil 28 of the electrical-power element 14 is electrified through the terminal 20 and a wiring line (not shown), the electrical-power element is actuated, thus causing the rotor 24 to rotate. By this rotation, the upper and lower rollers 46, 48 are fitted to the upper and lower eccentric portions 42, 44 that are integrally formed with the rotary shift 16, to eccentrically revolve in the upper and lower cylinders 38, 40 respectively.

Accordingly, a low pressure (the suction pressure of the first rotary compression element 32: 380 KPa) refrigerant gas is sucked into the low-pressure chamber side of the cylinder 40 from a suction port (not shown), through the refrigerant inlet pipe 94 and a suction path within the cylinder 40 is compressed by the operations of the roller 48 and the vane 52, to a medium pressure. The compressed refrigerant passes through the high-pressure chamber side of the lower cylinder 40, a discharge port (not shown), and the discharge-muffler chamber 64 which is formed in the lower-part support member 56. Then the compressed refrigerant is discharged into the sealed vessel 12 from the communication path (not shown) through an intermediate discharge pipe 121. Thus, the sealed vessel 12 has the medium pressure therein. In the preferred embodiment, the medium pressure is about 710 KPa when the displacement volume ratio of the second rotary compression element 34 to the first rotary compression element 32 is 60%, and the medium pressure is about 450 KPa when the displacement volume ratio of the second rotary compression element 34 to the first rotary compression element 32 is 90%.

Then, the medium pressure refrigerant gas in the sealed vessel 12 exits through the sleeve 144 and passes through the refrigerant inlet pipe 92 and a suction path 58 formed in the cylinder 38, and is sucked from a suction port (not shown) into the lower-pressure chamber side of the upper cylinder 38. The medium pressure refrigerant gas thus sucked undergoes a second-stage compression by the operations of the roller 46 and vane 50, and then become a high temperature and high pressure refrigerant gas (the discharge pressure (high-pressure) of the second rotary compression element 34 is 1890 KPa). Accordingly, the discharge valve 127 arranged in the discharge-muffler chamber 62 is opened for communicating with the discharge-muffler chamber 62 and the discharge port 39. Then, the high pressure refrigerant gas is discharged into the discharge-muffler chamber 62 formed in the upper-part support member 54 from the high-pressure chamber side of the upper cylinder 38 through the discharge port 39.

A part of the high pressure refrigerant gas that has been discharged into the discharge-muffler chamber 62 flows into the second back pressure chamber 80 through the communication path 90 described above and urge the vane 50 on the side of the roller 46. Moreover, the refrigerant flows into the first back pressure chamber 82 through the communication hole 110 formed in the partition plate 36 to urge the vane 52 on the side of the roller 48. On the other hand, the remaining refrigerant gas except for the part that has already been discharged into the discharge-muffler chamber 62, is discharged to the outside through the refrigerant discharge pipe 96.

When the operation of the rotary compressor 10 stops, the discharge-muffler chamber 62 and the second back pressure chamber 80 of the second rotary compression element 34 communicates with each other through the communication path 90, and the first back pressure chamber 82 of the first rotary compression element 32 and the second back pressure chamber 80 of the second rotary compression element 34 communicates with each other through the communication hole 110. Then, the high pressure refrigerant gas in the cylinder 38 is bypassed to the cylinder 40 through the back pressure chambers 80,82 through vanes 50, 52, guide grooves 70, 72 and springs 74, 76 and gaps between the receiving portions 70A, 72A. As a result, the high pressure refrigerant gas in the cylinder 38 reaches a balanced pressure in short time.

After the rotary compressor 10 stops, the pressure of the discharge-muffler chamber 62 becomes low and the pressure in the sealed vessel 12 becomes low. The pressure equalizing valve 401 is pressed downwardly due to the pressure in the sealed vessel 12 to open the pressure equalizing passage 400. According, the medium pressure refrigerant gas in the sealed vessel 12 flows into the discharge-muffler chamber 62.

By introducing the pressure, the pressure inside the discharge-muffler chamber 62 rises and the pressure inside the discharge-muffler chamber 62 becomes same as the sealed vessel 12, and the pressure equalizing valve 401 closes the pressure equalizing passage 400. On the other hand, because the discharge-muffler chamber 62 and each of the back pressure chambers 80, 82 are connected by the communication path 90 and the communication hole 110, the pressure inside the discharge-muffler chamber 62, back pressure chambers 80, 82, and each of the cylinders 40,38 are rapidly balanced in the sealed vessel 12. Therefore, the ability of re-start-up can be substantially improved.

Accordingly, in the present invention, a combustible refrigerant is used. The refrigerant compressed by the first rotary compression element 32 is discharged into the sealed vessel 12. The discharged medium pressure refrigerant is compressed by the second rotary compression element 34. The discharge-muffler chamber 62 of the second rotary compression element 34 and the second back pressure chamber 80 communicates with each other through the communication path 90. Moreover, the second back pressure chamber 80 and the first back pressure chamber 82 communicates with each other though the communication hole 110 formed in the intermediate partition plate 36. Therefore, the high pressure refrigerant gas in the discharge-muffler chamber 62 can be charged into the first and second back pressure chambers 80, 82.

Even if a rotary compressor 10 of medium pressure type is used, the vanes 50, 52 can be sufficiently urged on the side of the rollers 46, 48. Thus, the phenomena of unstable movement of the first and second rotary compression elements 32, 34 such as breakaway of the vane can be prevented.

Especially, the sealed vessel 12 of the present invention is set at a medium pressure, and the displacement volume ratio of the second rotary compression element 34 to the first rotary compression element 32 is set at a large value for reducing the medium pressure in the sealed vessel 12. Therefore, even at the time when actuating the rotary compressor 10, the pressure within the sealed vessel 12 is difficult to rise, the high pressure refrigerant gas that is discharged by the second rotary compression element 34 can be charged into the back pressure chambers 80, 82. The vane 52 is with sufficient back pressure since the actuation of the rotary compressor 10. The reliability of the rotary compressor 10 can be improved.

Moreover, after the rotary compressor 10 stops, because the discharge-muffler chamber 62 communicates with the second back pressure chamber 80 through the communication path 90, the second back pressure chamber 80 communicates with the first back pressure chamber 82 through the communication hole 110, and the sealed vessel 12 communicates with the discharge-muffler chamber 62 through the pressure equalizing passage 400, the pressure within the rotary compressor 10 rapidly reaches a balanced state.

As a result, the pressure difference within the rotary compressor 10 can be eliminated within a short time. Therefore, the actuation ability of the rotary compressor 10 can be remarkably improved.

Accordingly, in the present invention, a combustible refrigerant such as propane is used. The refrigerant that has been compressed by the first rotary compression element 32 is discharged into the sealed vessel 12. The discharged medium pressure refrigerant gas is compressed by the second rotary compression element 34. Therefore, the gas density of the refrigerant in the sealed vessel 12 can be lowered.

As a result, because the amount of refrigerant capable of being discharged into the sealed vessel 12 and melted into oil is lowered, the amount of the refrigerant sealed in the sealed vessel 12 can be decreased.

Figure 2:
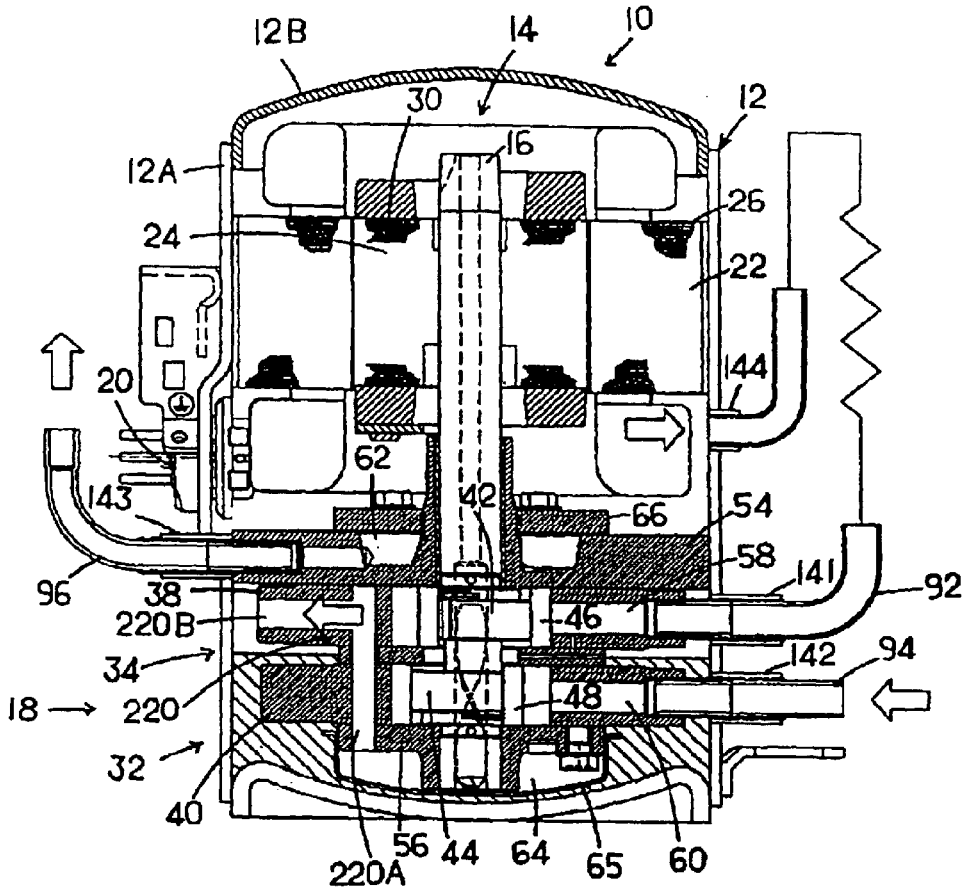
FIG. 2 is a vertical cross-sectional view showing a multi-stage compression type rotary compressor of medium pressure type according to another embodiment of the present invention.

As shown in FIG. 2, the refrigerant discharge pipe 96 is formed in the upper-part support member 54. The refrigerant that is compressed by the first rotary compression element 32 and then discharged into the discharge-muffler chamber 64 is discharged into the sealed vessel 12 through the passage 200B formed in the upper cylinder 38. It is to be noted that the same reference numerals in FIGS. 1 and 2 represent the same elements or the elements with the same functions.

In this case, the discharge-muffler chamber 64 communicates with the sealed vessel 12 through the communication path 220 that passes through the lower-part support member 56, upper and lower cylinders 38, 40, and the intermediate partition plate 36. The communication path 220 comprises a passage 220A that is vertically formed from the lower-part support member 56 of the discharge-muffler chamber 64 towards the center of the shaft, and a passage 220B that is formed vertical to the rotary shaft 16 from the side face of the cylinder 38 towards the center portion where the rotary shaft 16 is formed. The refrigerant gas that has been compressed by the first rotary compression element 32 is discharged into the sealed vessel 12 from the passage 220B through the passage 220A of the communication path 220.

Similar to the condition that the medium pressure refrigerant gas is discharged into the sealed vessel 12 from the side face of the cylinder 38, the amount of the refrigerant gas that is discharged to the sealed vessel 12 and melted into oil can be lowered. Therefore, the amount of the refrigerant sealed in the sealed vessel 12 of the rotary compressor 10 can be decreased.

Figure 3:
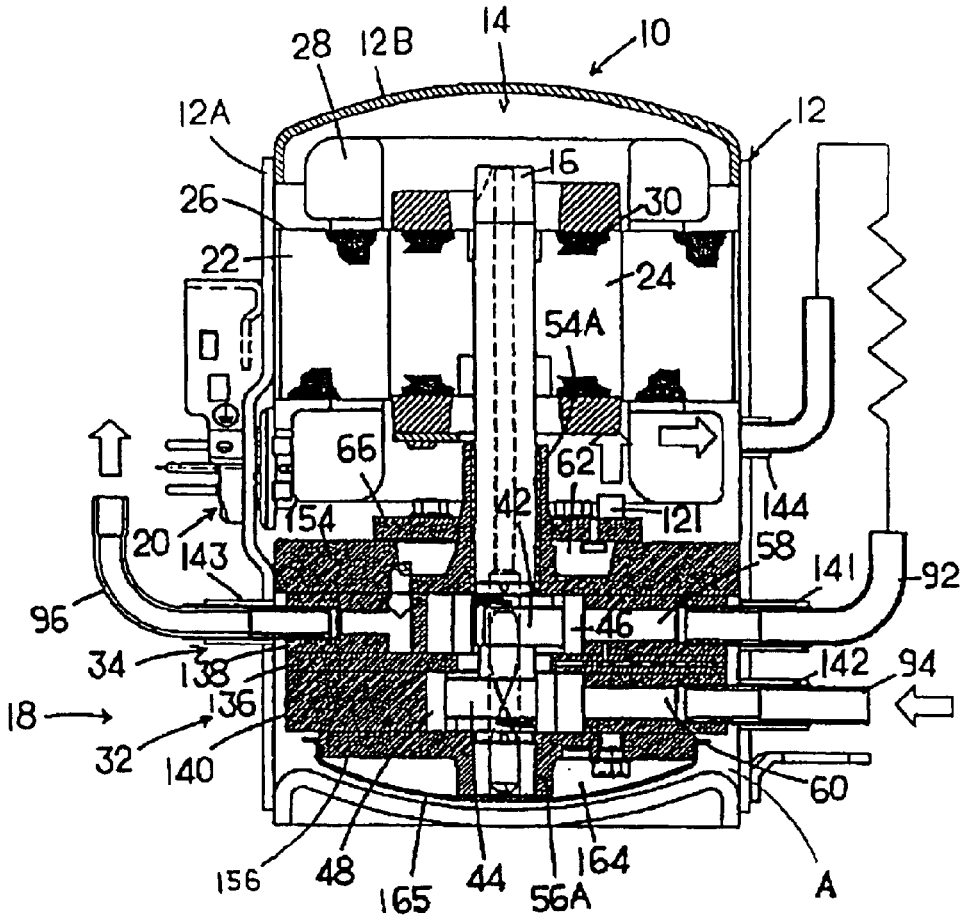
FIG. 3 is a vertical cross-sectional view showing a multi-stage compression type rotary compressor of medium pressure type according to still another embodiment of the present invention.

Referring to FIG. 3, an internal medium-pressure, multi-stage compression type rotary compressor 10 according to another embodiment of the present invention is shown. FIG. 3 is a vertical cross-sectional view showing an internal medium-pressure, multi-stage (two-stage) compression type rotary compressor 10. It is to be noted that the same reference numerals in FIGS. 1-3 represent the same elements or the elements with the same functions.

As shown in FIG. 3, a lower-part support member 156 blocks the lower opening face of the cylinder 140 and serves also as a bearing for the rotary shaft 16. A discharge-muffler chamber 164 is arranged at the side (the bottom side of the sealed vessel 12) opposite to the electrical-power element 14 of the lower-part support member 156 and is covered by a cup 165. The cup 165 has a through hole at its center for allowing the rotary shaft 16 pass through and the lower-part support member 156 for serving as the bearing of the rotary shaft 16.

By setting the volume ratio of the refrigerant in the sealed vessel to the sealed vessel 12 at 60% or less, the cylinders 138, 140, intermediate partition plate 136 and upper-part support member 154 are outlined to close to the internal surface of the sealed vessel 12. In other words, the cylinders 138, 140, intermediate partition plate 136 and the external surface of the upper-part support member 154 are close to the internal surface of the vessel body 12A while a gap from the vessel body 12A of the sealed vessel 12 is retained. Moreover, the lower-part support member 156 is also formed to close the internal surface of the sealed vessel 12. Accordingly, the cup 165 that covers the lower-part support member 156 is made large. The gap (space A) between the cup 165 and the internal bottom of the sealed vessel 12 is narrowed.

Figure 4:
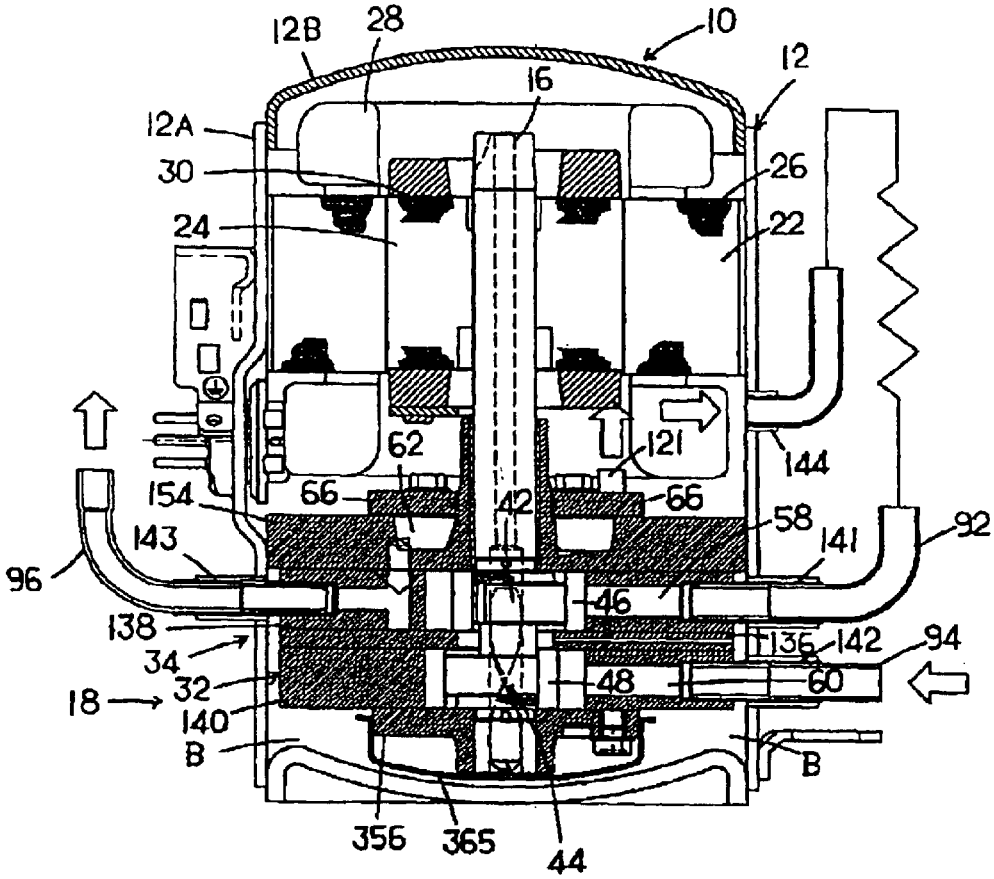
FIG. 4 (PRIOR ART)
FIG. 4 is a vertical cross-sectional view showing a conventional multi-stage compression type rotary compressor.

Referring to FIG. 4, there exists a lot of space (space B) between the external surface of the conventional lower-part support member 356 and the internal surface of the sealed vessel 12 or between the cup 365 and the internal bottom of the sealed vessel 12. The amount of the refrigerant sealed in the sealed vessel 12 becomes more because of the space B.

However, with the structure of the present invention, the space given for the refrigerant gas in the sealed vessel 12 becomes narrow. The amount of the refrigerant sealed in the sealed vessel 12 can be lowered.

Moreover, by reducing the space of the internal bottom of the sealed vessel 12 to space A, even if the oil amount stored in the oil reservoir is small, a sufficient oil surface can be maintained. The disadvantages such as oil-insufficiency can be prevented.

In addition to the above structure of the present invention, because the cylinders 138, 140, intermediate partition plate 136 and the external surface of the upper-part support member 154 are formed to close the internal surface of the vessel body 12A of the sealed vessel 12, and the volume ratio of the space A of the refrigerant existing in the sealed vessel 12 to the sealed vessel 12 is set to 60% or less, the amount of the refrigerant sealed in the sealed vessel 12 can be further decreased.

Moreover, because the oil reservoir of the internal bottom of the sealed vessel 12 becomes small, even if the oil amount in the sealed vessel 12 is small, the oil-surface can be maintained.

Although the embodiments described the cases with reference to the multi-stage compression type rotary compressor 10 in which the rotary shaft 16 is mounted vertically, of course the present invention can be also applied to the compressor in which the rotary shaft is mounted horizontally.

Furthermore, the multi-stage compression type rotary compressor has been described as a two-stage compression type rotary compressor equipped with first and second rotary compression elements, the present invention is not limited thereto; for example, the multi-stage compression type rotary compressor may be equipped with three, four, or even more stages of rotary compression elements.

Figure 9:
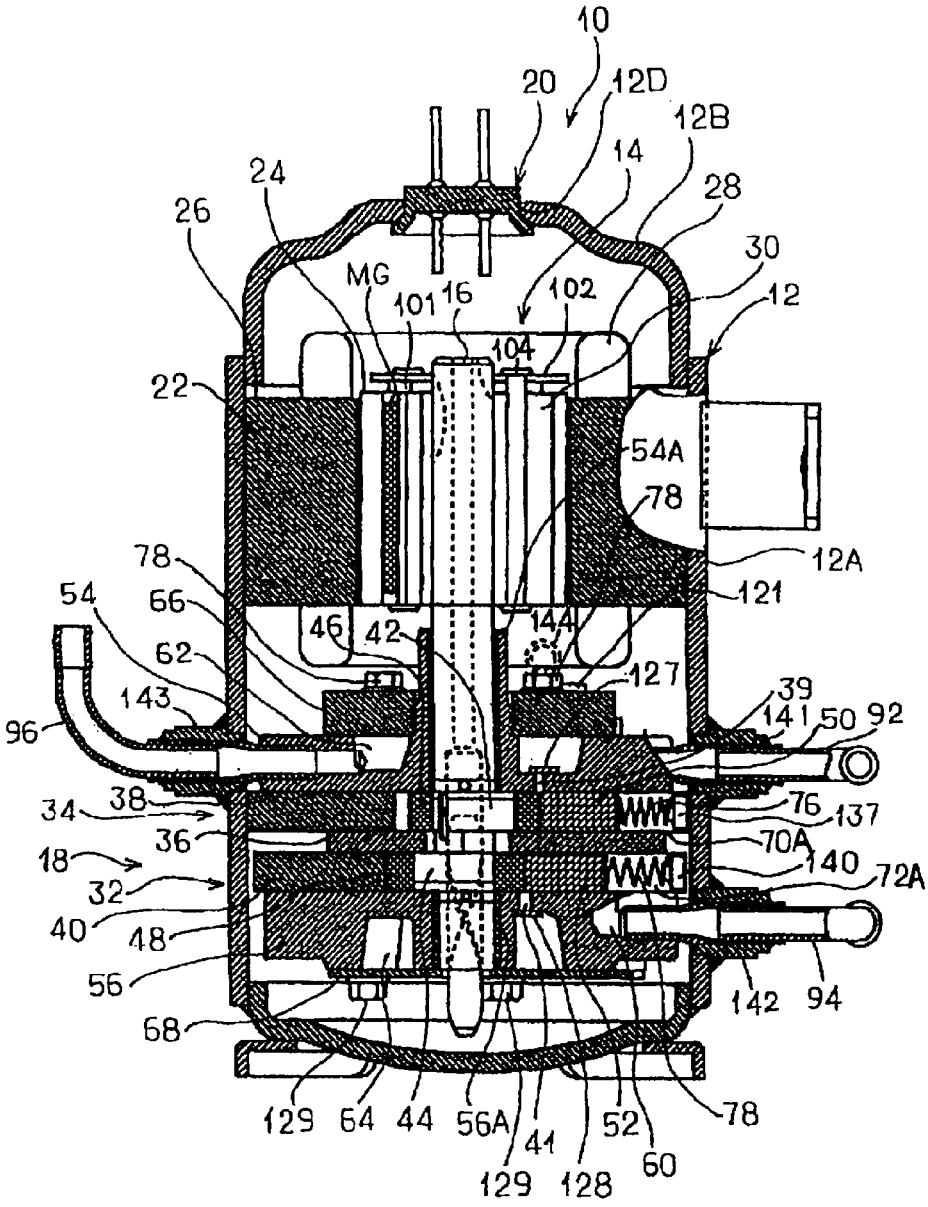
FIG. 9 is a vertical cross-sectional view showing a multi-stage compression type rotary compressor according to still another embodiment of the present invention.
Figure 10:
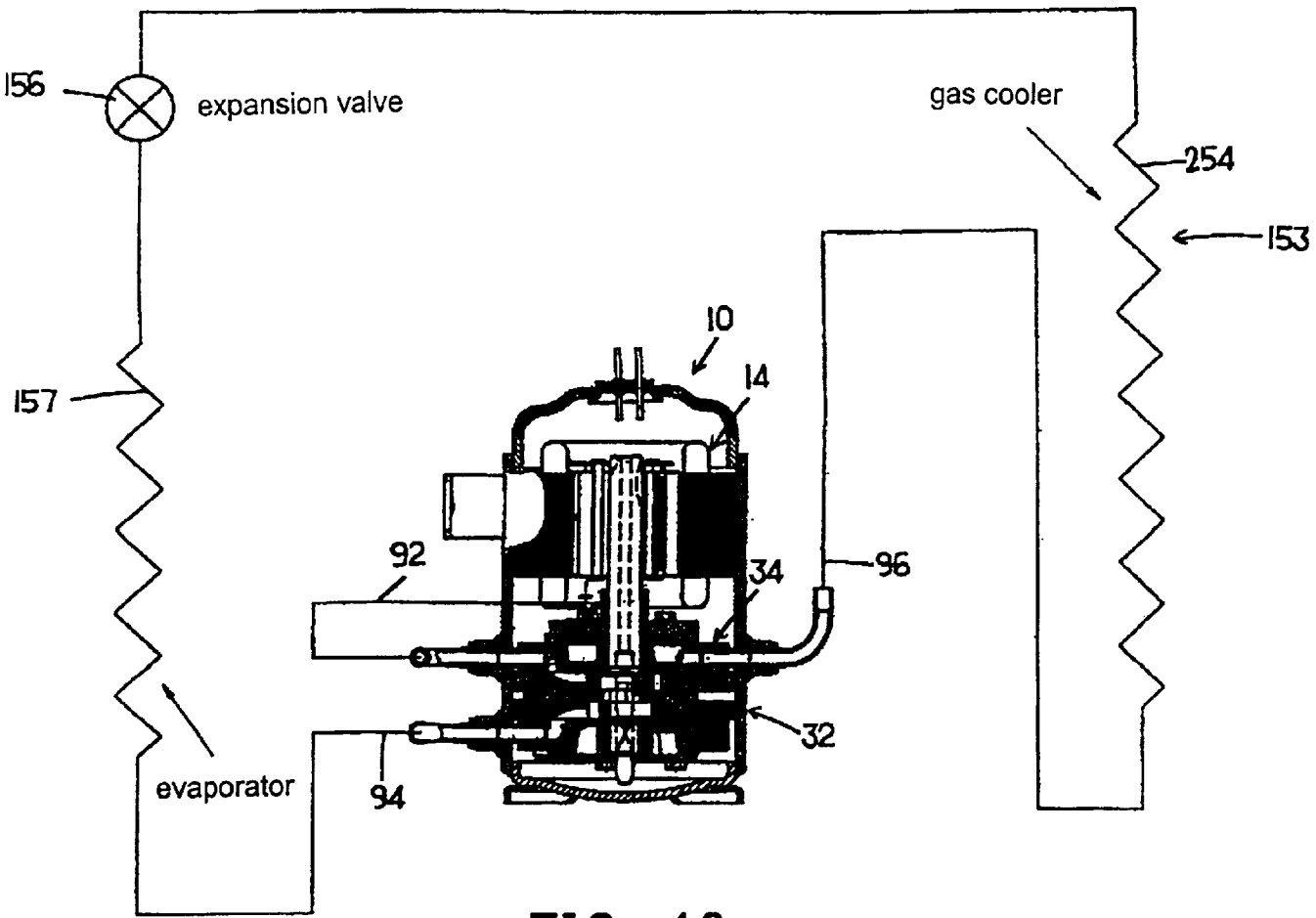
FIG. 10 is a diagram showing a refrigerant cycle of an oil-feeding apparatus that can be applied to the rotary compressor of the present invention.
Figure 11:
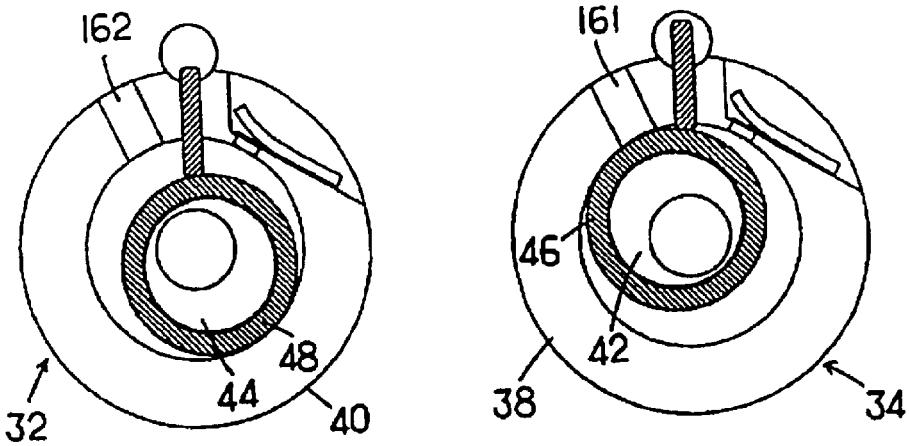
FIG. 11 is a vertical cross-sectional view showing cylinders of a first and second rotary compression elements of a single-stage compression type rotary compressor of two-cylinder type.
Figure 12:
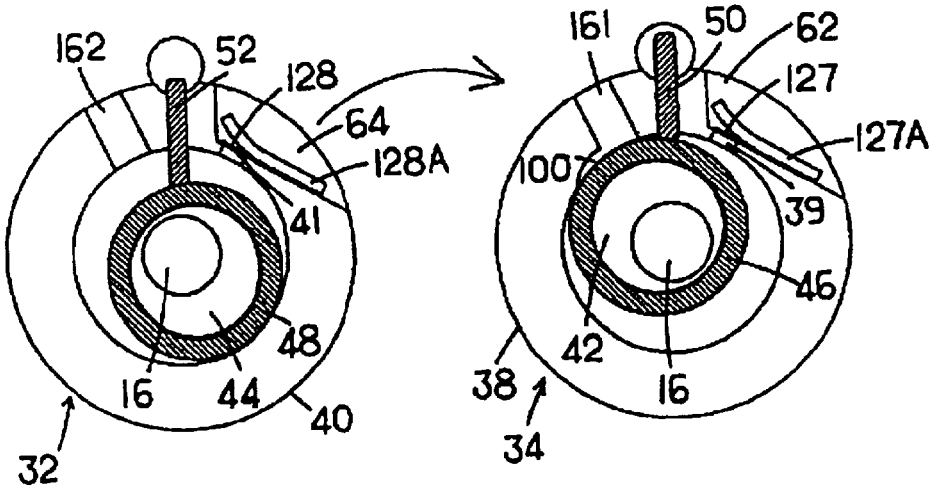
FIG. 12 is a vertical cross-sectional view showing the cylinders of the first and second rotary compression elements of the rotary compressor of FIG. 1 to which the present invention can be applied.
Figure 13:
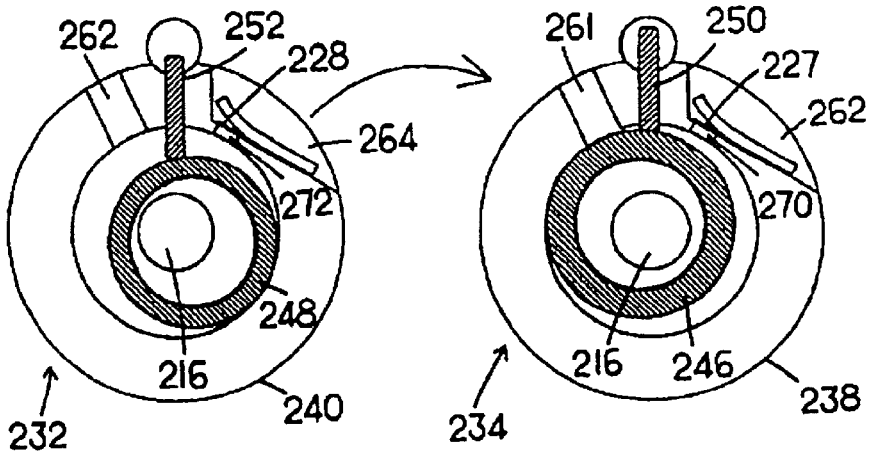
FIG. 13 (PRIOR ART)
FIG. 13 is a vertical cross-sectional view showing the cylinders of the first and second rotary compression elements of a conventional multi-stage compression type rotary compressor.

The following will describe the other embodiment of the present invention in detail with referring to the drawings. FIG. 9 is a vertical cross-sectional view showing an internal medium-pressure, multi-stage (two-stage) compression type rotary compressor according to an embodiment of the present invention. The rotary compressor 10 comprises first and second rotary compression elements 32, 34. FIG. 10 is a diagram for showing a refrigerant circuit of a hot-water supply apparatus 153 to which the rotary compressor of the present invention is applied. FIG. 11 is a cross-sectional view showing the cylinders of the first and the second rotary compression element of a single-stage rotary compressor with two cylinders. FIG. 12 is a cross-sectional view showing the cylinder 40 (the first cylinder) of the first rotary compression element 32 and the cylinder (the second cylinder) 38 of the second rotary compression element 34 to which the multi-stage compression type rotary compressor 10 of the present invention is applied.

Referring to FIG. 9, the internal medium-pressure, multi-stage compression type rotary compressor 10 comprises a sealed vessel 12, an electrical-power element 14 and a rotary compression mechanism portion 18. The sealed vessel 12 serving as a case is formed with a cylindrical vessel body 12A constructed from steel plate and a end cap (lid) 12B with a substantial bowl shape that closes the upper opening of the vessel body 12A. The electrical-power element 14 is arranged in the upper side of the inner space of the vessel body 12A of the sealed vessel 12. The rotary compression mechanism portion 18 is constructed with the first and second rotary compression elements 32, 34 that are arranged under the electrical-power element 14 and are driven by the rotary shaft 16 of the electrical-power element 14.

Additionally, the bottom of the sealed vessel 12 is used as an oil reservoir. A circular attachment hole 12D is formed on the center of the end cap 12B. A terminal 20 whose wires are omitted is installed in the attachment hole 12D for supplying electrical-power to the electrical-power element 14.

The electrical-power element 14 comprises a stator 22 that is annularly installed along the upper inner surface of the sealed vessel 12 and a rotor 24 inserted in the gaps enclosed by the stator 22. Thus, the rotary shaft 16 is fixed on the rotor 24 along a vertical direction.

The stator 22 has a stack 26 that is laminated with donut-shaped electromagnetic steel plates and a stator coil 28 that is wound round teeth of the stack 26 by direct winding (concentrated winding). Moreover, the rotor 24 is the same with the stator 22 that is formed with a stack 30 made of electromagnetic steel plate. A permanent magnet MG is inserted into the stack 30. After the permanent magnet MG is inserted into the stack 30, the upper and lower end of the stack 30 is covered by non-magnetic material (not shown). Balance weights 101 (the balance weight under the stack 30 is not shown) are installed on the surface of the non-magnetic material that is not in contact with the stack 30. Additionally, an oil-separation plate 102 is lapped over and installed on the balance weight 101 positioned on the stack 30.

The rotor 24, balance weight 101 and oil-separation plate 102 are penetrated by a rivet 104 to combine integrally.

On the other hand, the intermediate partition plate 36 is sandwiched between the first rotary compression element 32 and the second rotary compression element 34. That is, a combination of the first rotary compression element 32 and the second rotary compression element 34 is composed of the intermediate partition plate 36, an upper cylinder 38 and a lower cylinder 40 arranged above and below the intermediate partition plate 36 respectively, an upper roller 46 (the second roller) and a lower roller 48 (the first roller) which eccentrically revolve within the upper and lower cylinders 38 and 40 respectively at upper and lower eccentric portions 42 (the second eccentric portion) and 44 (the first eccentric portion) provided on the rotary shaft 16 with a phase difference of 180 degrees therebetween as shown in FIG. 11, vanes 50 (the second vane) and 52 (the first vane) which butt against the upper and lower rollers 46, 48 to divide an inside of the respective upper and lower cylinders 38 and 40 into a low-pressure chamber side and a high-pressure chamber side, and an upper-part support member 54 and a lower-part support member 56 given as a support member for blocking an upper-side opening face of the upper cylinder 38 and a lower-side opening face of the lower cylinder 40 respectively to serve also as a bearing for the rotary shaft 16.

Here, the first and second rotary compression elements 32,34 use the first and second rotary compression elements 32, 34 of a single-stage compression rotary compressor with two-cylinders, wherein a expansion portion 100 or a communication path (not shown), for discharging the refrigerant compressed by the first rotary compression element into the sealed vessel is formed.

The single-stage rotary compressor respectively sucks the refrigerant from the suction path (not shown) into the low-pressure chamber side of the first rotary compression element 32 of the cylinder 48 and into the low-pressure chamber side of the second rotary compression element 34 of the cylinder 38 through the suction ports 161, 162. The refrigerant gas that has been sucked into the low-pressure chamber side of the cylinder 40 is compressed to become high temperature by operations of the roller 48 and vane 52. Then, after the refrigerant is discharged into the discharge-muffler chamber 64 from the high-pressure chamber side of the cylinder 40 through the discharge port 41, the refrigerant is discharged into the discharge-muffler chamber 62 through the passage not shown and joins the other refrigerant gas that has been compressed in the cylinder 38.

On the other hand, the refrigerant gas sucked into the low-pressure chamber side of the cylinder 38 is then compressed to become high pressure by operations of the roller 46 and vane 50. The refrigerant gas is discharged into the discharge-muffler chamber 62 from the high-pressure chamber side of the cylinder 38 through the discharge port 39, and joins the other refrigerant gas that has been compressed in the cylinder 40. The joined high pressure refrigerant gas is discharged into the sealed vessel 12 through a discharge pipe (not shown).

The first and second rotary compression elements 32, 34 of the single-stage rotary compressor with two cylinders have the same displacement volume. In other words, the dimensions of the eccentric portions 42, 44 of the first and second rotary compression elements 32, 34 are same, the dimensions of the rollers 46, 48 are same, and the dimensions of the cylinders 38, 40 are same.

In the case when the rotary compression elements 32, 34 of the single-stage compression type rotary compressor is applied in the multi-stage compression type rotary compressor 10, the displacement volume ratio of the first and second rotary compression elements 32, 34 must change. If the displacement volume ratio of the first and second rotary compression element 32, 34 are set to be the same, the pressure difference (pressure difference between the suction pressure of the second rotary compression element and the discharge pressure of the second rotary compression element) of the second-stage becomes large. The compression load of the second rotary compression element becomes large. The ability of oil-feeding towards the rotary compression mechanism portion 18 may be insufficient due to the pressure difference. Then, the durability and reliability may deteriorate. Thus, the displacement volume of the second rotary compression element 34 is set to be smaller than that of the first rotary compression element 32 in order to limit the pressure difference of the second-stage.

In this case, an expansion portion 100 is formed in the upper cylinder 38 as shown in FIG. 12. The expansion portion 100 makes the outside of the upper cylinder 38 expand in a range of a predetermined angle in the rotation direction of the roller 46 from the suction port 161 of the upper cylinder 38. With this expansion portion 100, the compression-starting-angle of the refrigerant gas in the upper cylinder 38 can be delayed till the end of the rotation direction of the roller 46 of the expansion portion 100. That is, the starting of compression of the refrigerant can be delayed merely due to the angle of forming the expansion portion 100 of the cylinder.

Therefore, the amount of the refrigerant gas compressed in the upper cylinder 38 can be lowered. As a result, the displacement volume of the second rotary compression element 34 can be set small.

Accordingly, even if the dimensions of the eccentric portions 42 and 44 of the first and second rotary compression elements 32 and 34 are same, the dimensions of the rollers 46, 48 are same, and the dimensions of the upper and lower cylinders 38 and 40 are same, the displacement volume of the second rotary compression element 34 is set smaller than that of the first rotary compression element 32, and pressure difference (the difference between the suction pressure of the second rotary compression element and the discharge pressure of the second rotary compression element) of the second-stage can be prevented from becoming large.

That is, the displacement volume of the second rotary compression element 34 can be lowered merely due to forming the expansion portion 100 in the upper cylinder 38.

By merely partially processing the parts of the first and second rotary compression elements 32, 34 of the single-stage compression type rotary compressor with two-cylinders, these parts can be applied to the multi-stage compression type rotary compressor 10.

By merely forming the expansion portion 100 for properly expanding the upper cylinder 38 of the second rotary compression element 34, the displacement volume of the second rotary compression element 34 can be set smaller than that of the first rotary compression element 32. Therefore, the manufacturing cost can be decreased while setting the displacement volume ratio of the first and second rotary compression elements 32, 34.

Moreover, because the eccentric portions 42, 44 of the first and second rotary compression elements are in the same dimension, the workability of the rotary shaft 16 is improved. Thus, the manufacturing cost of the compressor can be decreased and the workability thereof can be improved.

A combination of the upper-part support member 54 and the lower-part support member 56 is provided therein with the suction path 60 (the suction port at the upper side is not shown) which communicates with insides of the upper and lower cylinders 38 and 40 through the suction ports 161 and 162 respectively and the discharge muffler chambers 62 and 64 formed by blocking concavities in the upper-part support member 54 and the lower-part support member 56 by covers serving as a wall respectively. That is, the discharge muffler chamber 62 is blocked by the upper cover 66 serving as a wall defining the discharge muffler chamber 62 and the discharge muffler chamber 64, by the lower cover 68 serving as a wall defining the discharge muffler chamber 64.

In this case, a bearing 54A is formed as erected at a center of the upper-part support member 54. At a center of the lower-part support member 56 is there formed a bearing 56A as going through, so that the rotary shaft 16 is held by the bearing 54A of the upper-part support member 54 and the bearing 56A of the lower-part support member 56.

The lower cover 68 is made of a donut-shaped circular steel plate to define the discharge-muffler chamber 64 communicating with an inside of the lower cylinder 40 of the first rotary compression element 32, and it is fixed upward to the lower-part support member 56 by four main bolts 129 disposed peripherally, tips of which are screwed to the upper-part support member 54.

A discharge valve 128 (it is shown in the same plane as the cylinder for explaining FIGS. 11 and 12) for opening or closing the discharge port 41 is set above the discharge-muffler chamber 64. The discharge valve 128 is constituted of a resilient member made of a vertically long rectangle metal plate. One side of the discharge valve 128 butts against the discharge port 41, such that the discharge valve 128 is sealed. The other side of the discharge valve 128 is fixed in an attachment hole (not shown) of the lower-part support member 56 that is separated from the discharge port 41 by riveting.

A backer valve 128A serving as a plate for limiting the discharge valve 128 is arranged at lower side of the discharge valve 128 and is installed in the lower-part support member 56.

The refrigerant gas that has been compressed in the lower cylinder 40 upon reaching a predetermined pressure presses the discharge valve 128 that closes the discharge port 41 to open the discharge port 41. The refrigerant gas is then discharged towards the discharge-muffler chamber 64. At this time, the other side of the discharge valve 128 is fixed in the lower-part support member 56. Therefore, the side of the discharge valve 128 that butts against the discharge port 41 bends to butt against the backer valve 128A that limits the extent or degree of opening of the discharge valve 128. When the discharging of the refrigerant gas is completed, the discharge valve 128 separates from the backer valve 128A and blocks the discharge port 41.

The discharge-muffler chamber 64 of the first rotary compression element 32 and the sealed vessel 12 are connected by a communication path described above. This communication path is a through hole (not shown) for allowing the support member 54, the upper cover 66, the upper and lower cylinders 38, 40, and the intermediate partition plate 36 to pass. In this case, an intermediate discharge pipe 121 is vertically set on the upper end of the communication path. A medium pressure refrigerant gas 12 is discharged into the sealed vessel through the intermediate discharge pipe 121.

The upper cover 66 defines the discharge-muffler chamber 62 communicating with an interior of the upper cylinder 38 of the second rotary compression element 34 through the discharge port 39. The electrical-power element 14 is set above the upper cover 66 with a predetermined gap. The upper cover 66 is made of a roughly donut-shaped circular steel plate in which a through hole is formed for allowing the bearing 54A of the upper-part support member 54 to pass through, and it is fixed downward to the upper-part support member 64 by four main bolts 78 disposed peripherally, tips of which are screwed to the lower-part support member 56.

A discharge valve 127 (it is shown in the same plane as the cylinder for convenient explanation) for opening or closing the discharge port 39 is set under the discharge-muffler chamber 62. The discharge valve 127 is constituted of a resilient member made of a vertically long rectangle metal plate. One side of the discharge valve 127 butts against the discharge port 39, such that the discharge valve 127 is sealed. The other side of the discharge valve 127 is fixed in an attachment hole of the support member 54 (not shown) that is separated from the discharge port 39 by a rivet.

A backer valve 127A serving as a plate for limiting the discharge valve 127 is arranged at an upper side of the discharge valve 127 and is installed in the upper-part support member 54.

The refrigerant gas that has been compressed in the upper cylinder 38 upon reaching a predetermined pressure presses the discharge valve 127 (it is shown in the same plane as the cylinder for explaining FIGS. 11 and 12) that closes the discharge port 39 to open the discharge port 39. The refrigerant gas is then discharged towards the discharge-muffler chamber 62. At this time, the other side of the discharge valve 127 is fixed in the upper-part support member 54. Therefore, the side of the discharge valve 127 that butts against the discharge port 39 bends to butt against the backer valve 127A that limits the extent or degree of opening of the discharge valve 127. When the discharging of the refrigerant gas is completed, the discharge valve 127 separates from the backer valve 127A and blocks the discharge port 39.

Guide grooves (not shown) for receiving vanes 50, 52 and receiving portions 70A, 72A disposed at the external side of the guide grooves for receiving springs 76, 78 serving as a resilient member are formed in the upper and lower cylinders 38, 40. The receiving portions 70A, 72A are opened at the side of the guide groove and at the side of the sealed vessel 12 (the vessel body 12A). The springs 76, 78 butt against the external end of the vanes 50, 52 and constantly urge the vanes 50, 52 on sides of rollers 46, 48. Metal-made plugs 137, 140 are provided on a side of the sealed vessel 12 with respect to the springs 76, 78 received in the receiving portions 70A, 72A respectively, for preventing fall-out of the springs 76, 78.

In this case, the refrigerant can use existing refrigerant such as HC refrigerant, mixing refrigerant in HC series, $CO_2$ refrigerant, mixing refrigerant of $CO_2$.

Onto a side face of the vessel body 12A of the sealed vessel 12, sleeves 141, 142, 143, and 144 are fixed by welding at positions that correspond to the suction path 60 (and an upper-side suction path not shown) of the respective upper-part support member 54 and the lower-part support member 56, the discharge-muffler chamber 62, and an upper side of the upper cover 66 (a lower end of the electrical-power element 14 roughly) respectively. The sleeves 141 and 142 are vertically adjacent to each other, while the sleeve 143 is roughly in a diagonal direction of the sleeve 141. Furthermore, the sleeve 144 is positioned as shifted by about 90 degrees with respect to the sleeve 141.

One end of a refrigerant inlet pipe 92 is inserted and connected in the sleeve 141 for introducing a refrigerant gas to the upper cylinder 38, which end communicates with the suction path (not shown), of the upper cylinder 38. This refrigerant inlet pipe 92 passes through an upper part of the sealed vessel 12 up to the sleeve 144, while the other end is inserted and connected in the sleeve 144 to communicate with the interior of the sealed vessel 12.

On the other hand, one end of a refrigerant inlet pipe 94 is inserted and connected in the sleeve 142 for introducing a refrigerant gas to the lower cylinder 40, which end communicates with the suction path 60 of the lower cylinder 40. The other end of this refrigerant inlet pipe 94 is connected to a lower end of an accumulator (not shown). Furthermore, a refrigerant discharge pipe 96 is inserted and connected in the sleeve 143, one end of which communicates with the discharge-muffler chamber 62.

The following will describe the refrigerant circuit with reference to FIG. 10. The multi-stage compression type rotary compressor 10 forms partial refrigerant circuit of a hot-water supply apparatus 153.

That is, the refrigerant discharge pipe 96 of the multi-stage compression type rotary compressor 10 is connected to the gas cooler 254. This gas cooler 254 is provided to a hot-water tank (not shown), of the hot-water supply apparatus 153 for heating water. The pipe exits the gas cooler 254 and passes through an expansion valve 156, which serves as a decompression device, up to evaporator 157, which is connected to the refrigerant inlet pipe 94 through an accumulator (not shown).

The following will describe operations with the above structure. When the stator coil 28 of the electrical-power element 14 is electrified through the terminal 20 and a wiring line not shown, the electrical-power element is actuated, thus causing the rotor 24 to rotate. By this rotation, the upper and lower rollers 46, 48 are fitted to the upper and lower eccentric portions 42, 44 provided integrally with the rotary shift 16, to eccentrically revolve in the upper and lower cylinders 38, 40 respectively.

A low pressure refrigerant gas sucked into the low-pressure chamber side of the lower cylinder 40 from a suction port 162 through the suction path 60 formed in the lower cylinder 40 is compressed by operations of the roller 48 and the vane 52 to a medium pressure. As a result, the discharge valve 128 arranged in the discharge-muffler chamber 64 is opened, and the discharge-muffler chamber 64 communicates with the discharge port 41. Thus, the refrigerant gas passes through the high-pressure chamber side of the lower cylinder 40, a discharge port 41, and the discharge-muffler chamber 64 formed in the lower-part support member 56, and is discharged into the sealed vessel 12. The refrigerant gas thus has been discharged into the discharge-muffler chamber 64 is discharged to the sealed vessel 12 from the communication path not shown through an intermediate discharge pipe 121.

Then, the medium pressure refrigerant gas in the sealed vessel 12 passes through the refrigerant inlet pipe 92 and a suction path (not shown) formed in the cylinder 38, and is sucked from a suction port 161, into the lower-pressure chamber side of the upper cylinder 38. The medium pressure refrigerant gas thus sucked undergoes second-stage compression by operations of the roller 46 and vane 50, and then become high temperature and high pressure. Accordingly, the discharge valve 127 arranged in the discharge-muffler chamber 62 is opened for communicating the discharge-muffler chamber 62 and the discharge port 39. Then, the high pressure refrigerant gas is discharged into the discharge-muffler chamber 62 formed in the upper-part support member 54 from the high-pressure chamber side of the upper cylinder 38 through the discharge port 39.

The high pressure refrigerant gas that has been discharged into the discharge-muffler chamber 62 flows into the gas cooler 254 through the refrigerant discharge pipe 96. At this moment, the refrigerant has a raised temperature of about +100° C. and, therefore, such a high temperature, high pressure gas radiates heat to heat water in the hot-water storage tank (not shown), from the gas cooler 254, thus generating hot water having a temperature of about +90° C.

The refrigerant itself is cooled at the gas cooler 254 and exits. Then, the refrigerant is decompressed at the expansion valve 156, flows into the evaporator 157 to evaporate (to absorb heat from the surroundings) there, passes through the accumulator (not shown), and is sucked into the first rotary compression element 32 through the refrigerant inlet pipe 94, and the cycle is repeated.

In the case when applying a rotary compression element of a single-stage compression type rotary compressor with two cylinders to a multi-stage compression type rotary compressor, by outwardly expanding the cylinder 38 constructing the second rotary compression element 34 in a range of a predetermined angle in the rotation direction of the roller 46 from the suction port 161, and by adjusting the compression-starting-angle of the second rotary compression element 34, the starting of the compression of the refrigerant in the cylinder 38 of the second rotary compression element can be delayed. Therefore, the displacement volume of the second rotary compression element 34 can be lowered.

As a result, without replacing the parts in the first and second rotary compression elements 32, 34, such as cylinders 38, 40 or rollers 46, 48 the displacement volume of the second rotary compression element 34 can be set smaller than the first rotary compression element 32. The manufacturing cost can be decreased while setting the displacement volume ratio of the first and second rotary compression elements 32, 34.

Especially, the present invention gives an effective performance in a two-stage (with high volume ratio) compression type rotary compressor in which the displacement volume of the second rotary compression element 34 approximates that of the first rotary compression element 32.

Furthermore, it has been described in the embodiment to use a rotary compression element of a single-stage compression rotary compressor with two cylinders as parts of the multi-stage compression type rotary compressor, the present invention is not limited thereto. For example, the single-stage compression type rotary compressor equipped with three, or more cylinders of rotary compression element can also be applied to the present invention.

Although the embodiments described the cases with reference to the multi-stage compression type rotary compressor 10 in which the rotary shaft 16 is vertically mounted, of course the present invention can also be applied to the compressor in which the rotary shaft is mounted horizontally.

Furthermore, the multi-stage compression type rotary compressor has been described as a two-stage compression type rotary compressor equipped with first and second rotary compression elements, the present invention is not limited thereto; for example, the multi-stage compression type rotary compressor may be equipped with three, four, or even more stages of rotary compression elements.

As detailed above, according to the embodiments of the present invention, the multi-stage compression type rotary compressor can use combustible refrigerant as refrigerant. The refrigerant that has been compressed by the first rotary compression element is discharged to the sealed vessel. The discharged medium pressure refrigerant is compressed by the second rotary compression element. Therefore, the pressure inside the sealed vessel becomes medium pressure. The gas density of the refrigerant that is discharged to the sealed vessel becomes low.

Accordingly, because the amount of the refrigerant gas discharged into the sealed vessel becomes few, the amount of the refrigerant gas sealed into the rotary compressor can be lowered. Because, the pressure in the vessel is lowered, the amount of the refrigerant melted into oil can be remarkably lowered.

Furthermore, because the displacement volume ratio of the second rotary compression element to the first rotary compression element is set large, the refrigerant gas discharged into the sealed vessel have a low pressure.

As a result, the density of the refrigerant gas in the sealed vessel can be decreased, and the amount of the refrigerant gas sealed into the rotary compressor can be further lowered.

Additionally, because the displacement volume ratio of the second rotary compression element to the first rotary compression element is set not less than 60%, the medium pressure that is compressed by the first rotary compression element is limited. Therefore, the gas density of the refrigerant inside the sealed vessel can be lowered.

Moreover, the displacement volume ratio of the second rotary compression element to the first rotary compression element is set not less than 60% and not more than 90%. Therefore, the phenomena of unstable operation of the first rotary compression element can be prevented, and the gas density of the refrigerant that is discharged to the sealed vessel can be lowered.

Furthermore, the volume ratio of the space where the refrigerant exists to the volume of the sealed vessel is set not less than 60%. Therefore, the existing space of the refrigerant gas inside the sealed vessel becomes smaller.

Accordingly, the amount of the refrigerant gas sealed into the rotary compressor can be further lowered.

Additionally, because the first and second cylinders constructing the first and second rotary compression elements, the first and second support members that block each opening face of the cylinders and also serves as a bearing for the rotary shaft, and intermediate partition plates that are arranged between cylinders are shaped close to the inner surface of the sealed vessel. Therefore, the existing space of the refrigerant gas in the sealed vessel can be efficiently reduced, and the amount of sealed refrigerant and oil can be remarkably lowered.

By lowering the internal bottom space of the sealed vessel, even if the oil stored in the oil reservoir is small, a sufficient oil surface can be maintained. The oil insufficiency condition can be prevented.

Moreover, the multi-stage compression type rotary compressor comprises: a first and second cylinders constructing a first and second rotary compression elements, a first and second rollers that rotates eccentrically with eccentric portions formed on the rotary shaft of the electrical-power element, a first and second vanes that are in contact with rollers to divide each cylinder into a low-pressure chamber side and a high-pressure chamber side, and a first and second back pressure chambers for constantly urging each vane towards the roller side. A combustible refrigerant is applied as a refrigerant. The refrigerant that has been compressed by the first rotary compression element is discharged to the sealed vessel. The discharged medium pressure refrigerant gas is compressed by the second rotary compression element. At the same time, the discharging side of the refrigerant in the second rotary compression element is connected to the first and second back pressure chambers. Therefore, the high pressure refrigerant gas that has been compressed by the second rotary compression element is charged to the first and second back pressure chambers.

As a result, because the high pressure refrigerant gas that has been compressed by the second rotary compression element can be charged into the first and second back pressure chambers, some unstable movements such as the breakaway of vanes resulting from the rapidly rising of the back pressure during the actuation of the rotary compressor can be prevented. Therefore, the reliability of the rotary compressor can be improved.

Furthermore, the multi-stage compression type rotary compressor comprises: a support member that blocks the opening face of the second cylinder, a discharge-muffler chamber formed in the support member for discharging the refrigerant that has been compressed in the second cylinder, a communication path formed in the support member and is connected with the discharge-muffler chamber and the second back pressure chamber, a intermediate partition plate arranged between the first and second cylinders, and a communication hole formed in the intermediate partition plate and is connected with the second and first back pressure chambers. Therefore, the high-pressure at the discharging side of the refrigerant in the second rotary compression element can be charged to the first and second back pressure chambers with a relatively simple structure. As a result, the workability of the compressor can be improved, and the manufacturing cost can be lowered.

Additionally, the multi-stage compression type rotary compressor comprises: a pressure equalizing passage that communicates with the discharge-muffler chamber and the sealed vessel, and a pressure equalizing valve that opens or closes the pressure equalizing passage. The pressure equalizing valve opens the pressure equalizing passage when the pressure inside the discharge-muffler chamber is lower than that inside the sealed vessel. Therefore, the pressure within the first and second rotary compression elements and the sealed vessel can be rapidly equalized.

As a result, the pressure difference between high and low pressure in the rotary compressor can be eliminated within a short time, the actuation ability of the rotary compressor can remarkably improved.

Moreover, the multi-stage compression type rotary compressor uses a combustible refrigerant. The refrigerant that has been compressed by the first rotary compression element is discharged into the sealed vessel. The medium pressure refrigerant that has been discharged is compressed by the second rotary compression element. The compressor comprises a pressure equalizing valve that communicates with the discharging side of the refrigerant in the second rotary compression element and the sealed vessel in the case when the pressure at the discharging side of the refrigerant in the second rotary compression element is lower than the pressure inside the sealed vessel. Thus, after the compressor stops, the pressure within the sealed vessel can be rapidly pressure equalized.

Furthermore, the multi-stage compression type rotary compressor comprises: a cylinder that constructs the second rotary compression element cylinder, a support member that blocks the opening face of the cylinder, a discharge-muffler chamber formed in the support member and discharges the refrigerant that has been compressed in the cylinder, a cover that divides the discharge-muffler chamber and the sealed vessel, and a pressure equalizing passage formed in the cover. The pressure equalizing valve is arranged inside the discharge-muffler chamber to open or close the pressure equalizing passage. Therefore, the productivity and the efficiency of space-usage of the compressor can be improved.

Additionally, the dimensions of the first and second eccentric portions are same, the dimensions of the first and second rollers are same, and the dimensions of the first and second cylinders are same. The second cylinder extends outwardly with a predetermined angle range in the rotation direction of the second roller from the suction port. Therefore, the starting of the compression of the refrigerant in the cylinder of the second rotary compression element becomes delayed.

As a result, without replacing the parts in the first and second rotary compression elements, such as cylinders or rollers, the displacement volume of the second rotary compression element can be set smaller than the first rotary compression element. Therefore, the manufacturing cost can be decreased while setting the displacement volume ratio of the first and second rotary compression elements Because the eccentric portions of the shaft for the first and second rotary compression elements are in the same dimensions, the workability of the rotary shaft can be improved. Therefore, the manufacturing cost of the compressor can be lowered, and the productivity thereof can be improved.

Moreover, according to the embodiments of the present invention there are provided also a setting method of displacement volume ratio for the multi-stage compression type rotary compressor. The method comprises: extending the second cylinder outwardly with a predetermined angle range in the rotation direction of the second roller from the suction port; setting the displacement volume ratio of the first and second rotary compression elements by adjusting the compression-starting-angle. Therefore, the starting of the compression of the refrigerant in the cylinder in the second rotary compression element can be delayed. The displacement volume of the second rotary compression element can be lowered.

As a result the displacement volume ratio of the first and second rotary compression elements can be changed without replacing parts in the first and second rotary compression elements, such as cylinders, rollers. The cost due to the replacing of parts can be eliminated.

Because the dimensions of the eccentric portions of the rotary shaft for the first and second rotary compression elements are same, the workability of the rotary shaft can be improved. The manufacturing cost of the compressor can be lowered and the operation performance can be improved.

While the present invention has been described with preferred embodiments, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. A multi-stage compression type rotary compressor comprising:

a sealed vessel;

an electrical-power element having a rotary shaft;

a first rotary compression element and a second rotary compression element driven by the rotary shaft of the electrical-power element, wherein the electrical-power element and the first and second rotary compression elements are arranged in the sealed vessel, wherein a refrigerant compressed by the first rotary compression element is compressed by the second rotary compression element, and wherein the refrigerant comprises a combustible refrigerant, and the refrigerant compressed by the first rotary compression element is discharged into the sealed vessel, and the discharged refrigerant is under a medium pressure and is further compressed by the second rotary compression element; and a pressure equalizing device, for equalizing a pressure of the refrigerant in the second rotary compression element and a pressure of the sealed vessel when the pressure of the refrigerant in the second rotary compression element is lower than the pressure in the sealed vessel.

2. The rotary compressor according to claim 1, wherein a displacement volume ratio of the second rotary compression element to the first rotary compression element is set large.

3. The rotary compressor according to claim 1, wherein a displacement volume ratio of the second rotary compression element to the first rotary compression element is set not less than 60%.

4. The rotary compressor according to claim 1, wherein a displacement volume ratio of the second rotary compression element to the first rotary compression element is set not less than 60% and not more than 90%.

5. The rotary compressor according to claim 1, wherein a displacement volume ratio of an existing space, to which the refrigerant exits, to a volume of the sealed vessel is set not less than 60%.

6. The rotary compressor according to claim 5, wherein a first cylinder and a second cylinder constructing the first and second rotary compression elements, a first support member and a second support member blocking each opening face of the cylinders and serving also as a bearing for the rotary shaft, and an intermediate partition plate arranged between the cylinders are shaped close to an inner surface of the sealed vessel.

7. The rotary compressor according to claim 1, comprising:

a first cylinder and a second cylinder constructing the first and second rotary compression elements;

a first roller and a second roller rotating eccentrically with eccentric portions provided on the rotary shaft of the electrical-power element;

a first vane and a second vane in contact with the rollers to divide the each cylinder into a law-pressure chamber side and a high-pressure chamber side; and a first back pressure chamber and a second back pressure chamber for constantly urging the each vane on a side of the roller, wherein the discharged medium pressure refrigerant is compressed by the second rotary compression element, and a discharge side of the refrigerant in the second rotary compression element communicates with the first and second back pressure chambers.

8. The rotary compressor according to claim 7, comprising:

a support member blocking an opening face of the second cylinder;

a discharge-muffler chamber formed in the support member for discharging the refrigerant compressed in the second cylinder;

a communication path formed in the support member and communicating with the discharge-muffler chamber and the second back pressure chamber; and an intermediate partition plate sandwiched between the first and second cylinders, wherein a communication hole for communicating with the second and first back pressure chambers is formed in the intermediate partition plate.

9. The rotary compressor according to claim 8, comprising:

a pressure equalizing passage communicating with the discharge-muffler chamber and the sealed vessel; and a pressure equalizing valve, as a part of the pressure equalizing device, opening or closing the pressure equalizing passage, wherein the pressure equalizing valve opens the pressure equalizing passage when the pressure inside the discharge-muffler chamber of the second rotary compression element is lower than the pressure within the sealed vessel.

10. A multi-stage compression type rotary compressor comprising:

a sealed vessel;

an electrical-power element having a rotary shaft;

a first rotary compression element and a second rotary compression element driven by the rotary shaft of the electrical-power clement, wherein the electrical-power element and the first and second rotary compression elements are arranged in the sealed vessel, and a refrigerant compressed by the first rotary compression element is compressed by the second rotary compression element, and the refrigerant comprises a combustible refrigerant, and the refrigerant compressed by the first rotary compression element is discharged to the sealed vessel, and the discharged refrigerant is under a medium pressure and is further compressed by the second rotary compression element; and a pressure equalizing valve for communicating with the discharge side of the refrigerant in the second rotary compression element and the sealed vessel when a pressure at a discharge side of the refrigerant in the second rotary compression element is lower than a pressure in the sealed vessel.

11. The rotary compressor according to claim 10, comprising:

a cylinder constructing the second rotary compression element;

a support member blocking an opening face of the cylinder;

a discharge-muffler chamber formed in the support member and discharging the refrigerant compressed in the cylinder;

a cover dividing the discharge-muffler chamber and the sealed vessel; and a pressure equalizing passage formed in the cover, wherein the pressure equalizing valve is arranged inside the discharge-muffler chamber to open or close the pressure equalizing passage.

12. A multi-stage compression type rotary compressor comprising:

a sealed vessel;

an electrical-power element having a rotary shaft;

a first rotary compression element and a second rotary compression element driven by the electrical-power element;

a first cylinder and a second cylinder constructing the first and second rotary compressor elements; and a first roller and a second roller eccentrically respectively revolving within the cylinders at a first eccentric portion and a second eccentric portion provided on the rotary shaft with a phase difference therebetween, wherein the electrical-power element, the first and second rotary compression elements, and the first and second rollers are arranged in the vessel, wherein a refrigerant compressed and discharged by the first rotary compression element is sucked into, compressed and then discharged by the second rotary compression element, and dimensions of the first and second eccentric portions are same, dimensions of the first and second rollers are same, and dimensions of the first and second cylinders are same, and the second cylinder is expanded outwardly from a suction port in a range of a predetermined angle in a rotation direction of the second roller.

13. A setting method of displacement volume ratio for a multi-stage compression type rotary compressor, comprising an electrical-power element, first and second rotary compression elements driven by a rotary shaft of the electrical-power element, first and second rollers respectively eccentrically revolving within the cylinders at a first eccentric portion and a second eccentric portion provided on the rotary shaft with a phase difference therebetween in a sealed vessel, wherein a refrigerant compressed and discharged by the first rotary compression element is sucked and then compressed and discharged by the second rotary compression element, wherein the method comprising:

constructing the first and second eccentric portions, the first and second rollers, and the first and second cylinders, wherein dimensions of the first and second eccentric portions are same, dimensions of the first and second rollers are same, and dimension of the first and second cylinders are same; and setting a displacement volume ratio of the first and second rotary compression elements by expanding the second cylinder outwardly from a suction port in a range of a predetermined angle in a rotation direction of the second roller to adjust a compression-starting angle of the second rotary compression element.

* * * * *